US009298128B2

(12) United States Patent
Orihara et al.

(10) Patent No.: US 9,298,128 B2
(45) Date of Patent: Mar. 29, 2016

(54) IMAGE FORMING APPARATUS

(71) Applicant: CANON KABUSHIKI KAISHA, Tokyo (JP)

(72) Inventors: Tatsuaki Orihara, Tokyo (JP); Shuhei Tokiwa, Tokyo (JP); Kazunari Hagiwara, Yokohama (JP); Manami Haraguchi, Yokohama (JP); Makoto Fukatsu, Suntou-gun (JP); Atsushi Nakamoto, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/533,283

(22) Filed: Nov. 5, 2014

(65) Prior Publication Data

US 2015/0132030 A1 May 14, 2015

(30) Foreign Application Priority Data

Nov. 13, 2013 (JP) ..... 2013-235290

(51) Int. Cl.

| | |
|---|---|
| ***G03G 15/08*** | (2006.01) |
| ***G03G 15/06*** | (2006.01) |
| ***G03G 15/00*** | (2006.01) |

(52) U.S. Cl.

CPC ..... *G03G 15/0812* (2013.01); *G03G 15/065* (2013.01); *G03G 15/0818* (2013.01); *G03G 15/5037* (2013.01); *G03G 2215/0861* (2013.01)

(58) Field of Classification Search

CPC ..... G03G 15/065; G03G 15/0812; G03G 15/0818; G03G 2215/0858–2215/0863

See application file for complete search history.

(56) References Cited

U.S. PATENT DOCUMENTS

| | | | | |
|---|---|---|---|---|
| 4,521,103 | A | 6/1985 | Ohtsuka et al. | |
| 4,717,999 | A | 1/1988 | Kaneko | |
| 5,862,444 | A | 1/1999 | Machida et al. | |
| 6,287,246 | B1 * | 9/2001 | Yoshii et al. | 492/59 |
| 7,233,758 | B2 | 6/2007 | Osada et al. | |
| 7,239,831 | B2 | 7/2007 | Hagiwara et al. | |
| 7,251,441 | B2 | 7/2007 | Hagiwara et al. | |
| 7,379,693 | B2 | 5/2008 | Ogawa et al. | |
| 7,383,003 | B2 | 6/2008 | Kichijima et al. | |

(Continued)

FOREIGN PATENT DOCUMENTS

| | | | |
|---|---|---|---|
| JP | S57-066456 | A | 4/1982 |
| JP | 07-031454 | B2 | 4/1995 |
| JP | 2005-326481 | A | 11/2005 |

OTHER PUBLICATIONS

Tatsuaki Orihara et al., U.S. Appl. No. 14/533,285, filed Nov. 5, 2014.

(Continued)

*Primary Examiner* — David Gray
*Assistant Examiner* — Carla Therrien
(74) *Attorney, Agent, or Firm* — Fitzpatrick, Cella, Harper & Scinto

(57) ABSTRACT

In an image forming apparatus having a photosensitive drum that carries a toner image, a developing roller is provided to be capable of rotating while carrying toner and supplies the toner to the photosensitive drum in order to develop a latent image, and a voltage applying device applies a voltage to the developing roller. The developing roller includes a conductive base layer and a surface layer covering the base layer, and a surface charge density of the developing roller is equal to or smaller than a surface charge density of the toner.

10 Claims, 14 Drawing Sheets

(56) References Cited

U.S. PATENT DOCUMENTS

| | | | | |
|---|---|---|---|---|
| 7,440,718 | B2 | 10/2008 | Hagiwara et al. | |
| 7,715,744 | B2 | 5/2010 | Miyazawa et al. | |
| 7,773,923 | B2 | 8/2010 | Hagiwara et al. | |
| 7,826,758 | B2 | 11/2010 | Miyazawa et al. | |
| 8,190,044 | B2 * | 5/2012 | Kitamura et al. | 399/55 |
| 8,204,412 | B2 | 6/2012 | Kubo et al. | |
| 2004/0240907 | A1 * | 12/2004 | Miyaguchi et al. | 399/254 |
| 2010/0054780 | A1 | 3/2010 | Kitamura et al. | |
| 2010/0124427 | A1 * | 5/2010 | Sugiyama | 399/53 |
| 2010/0209147 | A1 * | 8/2010 | Kubo et al. | 399/270 |
| 2013/0216263 | A1 | 8/2013 | Miyazawa et al. | |

OTHER PUBLICATIONS

European Search Report dated Apr. 7, 2015, in related European Patent Application No. 14192771.5.

* cited by examiner

| FILM THICKNESS | DENSITY | Q/M |
|---|---|---|
| 10 | 1.0916 | 66.3 |
| 100 | 1.1004 | 59.8 |
| 500 | 1.08 | 70 |
| 1000 | 0.9938 | 93.3 |

IMAGE FORMING APPARATUS

BACKGROUND OF THE INVENTION

1. Field of the Invention

The present invention relates to an image forming apparatus.

2. Description of the Related Art

A conventional image forming apparatus using an electrophotographic system includes a photosensitive drum serving as an image bearing member and a developing roller serving as a developer carrying member. In this image forming apparatus, a development process for visualizing a latent image formed on the photosensitive drum is performed by transferring toner serving as a developer carried on the developing roller to the latent image. In a region (referred to hereafter as a non-image portion) of the photosensitive drum where the toner is not to be transferred, within a contact region (referred to hereafter as a developing nip portion) where the photosensitive drum contacts the developing roller, a voltage is applied so that the toner receives a force traveling from the photosensitive drum toward the developing roller.

Here, non-image portion contamination (referred to hereafter as fog) may occur when the toner is transferred to the non-image portion of the photosensitive drum, where the toner is not intended to be transferred. Fog is generated when a charge of the toner decays or a polarity of the toner reverses in the developing nip portion where the photosensitive drum contacts the developing roller. It is known that a charge-providing performance in relation to the toner deteriorates particularly in a high humidity environment. When the charge-providing performance in relation to the toner deteriorates, the charge of the toner decays, leading to an increase in the amount of fog.

Japanese Patent Publication No. H7-31454 proposes setting a volume resistance of the developing roller at or above a predetermined value in order to suppress the occurrence of fog in which toner is transferred onto a non-image portion of a photosensitive drum.

SUMMARY OF THE INVENTION

However, the occurrence of fog is also dependent on a circumferential speed of the developing roller, the voltage applied to the developing nip portion where the developing roller contacts the photosensitive drum, and so on. Further, when the number of printed sheets increases, toner deterioration advances, leading to a dramatic reduction in the toner charge and a likely increase in the amount of fog. These elements have an extremely large effect, and it has been found to be impossible to suppress fog with stability over time using the method proposed in Japanese Patent Publication No. H7-31454. Moreover, when the volume resistance of the developing roller is simply increased, a development performance deteriorates due to a reduction in density and so on.

Hence, in consideration of the problems described above, an object of the present invention is to suppress the occurrence of fog while maintaining a favorable development performance.

To achieve this object, an image forming apparatus according to the present invention comprising:

an image bearing member capable of bearing a developer image that is formed by supplying a developer to a latent image formed on a surface thereof;

a developer carrying member that is provided to be capable of rotating while carrying the developer, and that supplies the developer to the image bearing member by contacting the image bearing member;

a regulating member that regulates a layer thickness of the developer carried on the developer carrying member; and a voltage applying device for applying a voltage to the developer carrying member, wherein the developer carrying member includes a conductive base layer and a surface layer covering the base layer, and when a volume resistance of the surface layer is ρc, a film thickness thereof is dc, and a relative dielectric constant thereof is ∈c, a surface charge density of the developer on the developer carrying member, the film thickness of which has been regulated by the regulating member, is q/s, a relative dielectric constant thereof is ∈t, and a layer thickness thereof is dt, a potential of the surface of the image bearing member in a contact region with the developer carrying member is V, and a time required for the developer to pass through the contact region after entering the contact region as the developer carrying member rotates is T, $$\left|\frac{VT}{\rho_c d_c}\right| \leq \left|\frac{q}{s}\right|$$

$$\frac{d_c}{\varepsilon_c} \leq \frac{d_t}{\varepsilon_t}$$

is satisfied.

Further, the image forming apparatus according to the present invention comprising:

an image bearing member capable of bearing a developer image that is formed by supplying a developer to a latent image formed on a surface thereof;

a charging device for charging the surface of the image bearing member;

an exposure device for forming the latent image by exposing the charged surface of the image bearing member;

a developer carrying member that is provided to be capable of rotating while carrying the developer, and that supplies the developer to the image bearing member by contacting the image bearing member;

a regulating member that regulates a layer thickness of the developer carried on the developer carrying member; and a voltage applying device for applying a voltage to the developer carrying member, wherein the developer carrying member includes a conductive base layer and a surface layer covering the base layer, and when a volume resistance of the surface layer is ρc, a film thickness thereof is dc, and a relative dielectric constant thereof is ∈c, a surface charge density of the developer on the developer carrying member, the film thickness of which has been regulated by the regulating member, is q/s, a relative dielectric constant thereof is ∈t, and a layer thickness thereof is dt, a potential difference between a surface potential of an unexposed region of the surface of the image bearing member charged by the charging device and a surface potential of the developer carrying member is Vback, and a time required for the developer to pass through the contact region after entering the contact region as the developer carrying member rotates is T, $$\left|\frac{V_{back}T}{\rho_c d_c}\right| \leq \left|\frac{q}{s}\right|$$

$$\frac{d_c}{\varepsilon_c} \leq \frac{d_t}{\varepsilon_t}$$

is satisfied.

According to the present invention, the occurrence of fog can be suppressed while maintaining a favorable development performance.

Further features of the present invention will become apparent from the following description of exemplary embodiments with reference to the attached drawings.

DESCRIPTION OF THE EMBODIMENTS

Embodiments of the present invention will be described using examples with reference to the drawings. Dimensions, materials and shapes of the components and relative configurations thereof according to the embodiments should be appropriately changed in accordance with the configuration and various conditions of the apparatus to which the invention is applied. In other words, the following embodiments are not intended to limit the scope of the present invention.

<<First Embodiment>>

Figure 1:
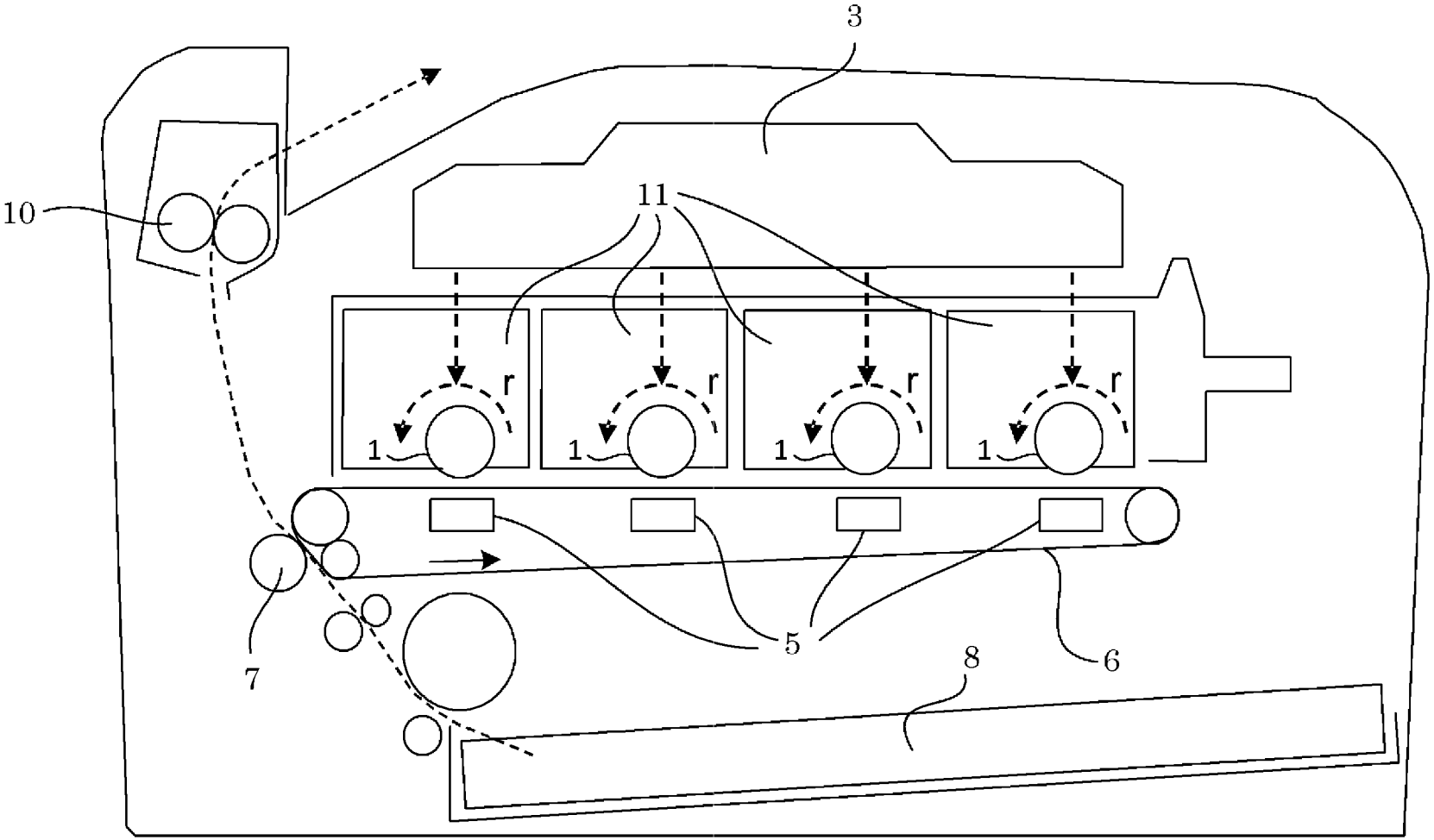
FIG. 1 is a schematic sectional view showing a configuration of an image forming apparatus according to an embodiment.
Figure 2A:
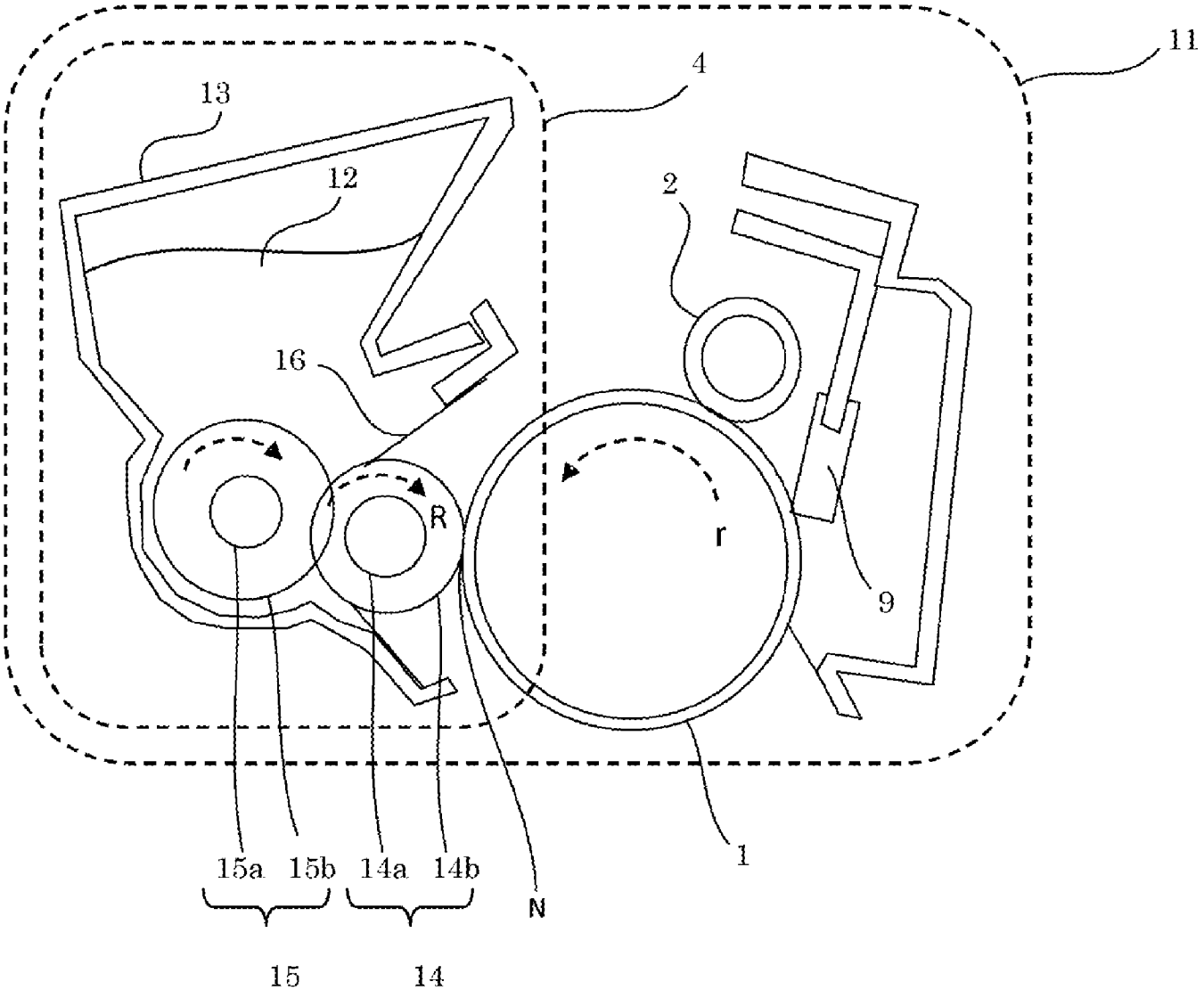
FIGS. 2A and 2B are schematic sectional views showing a configuration of a cartridge according to a first embodiment.
Figure 2B:
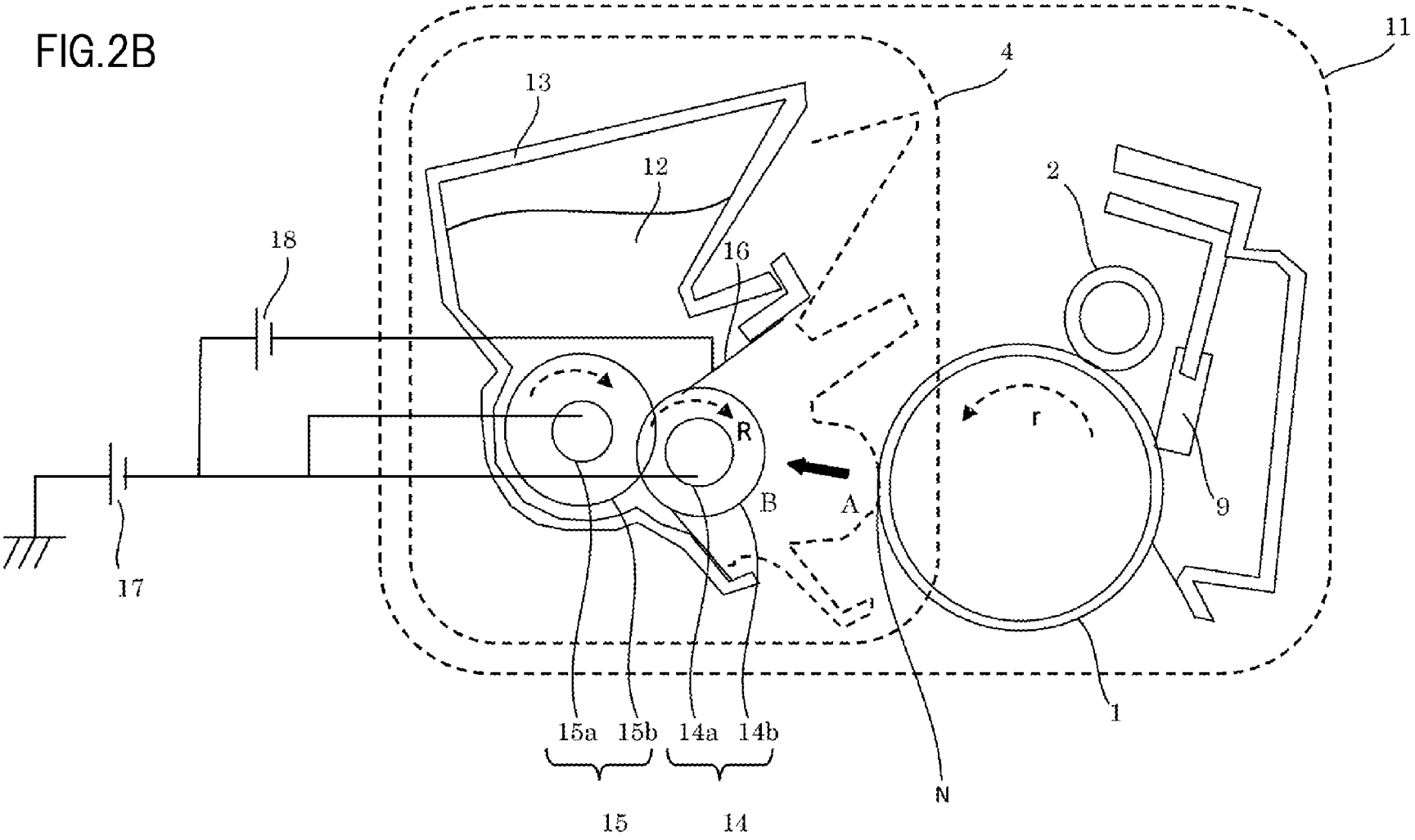

Referring to FIGS. 1 and 2, an embodiment of the present invention will be described. FIG. 1 is a schematic sectional view showing a configuration of an image forming apparatus according to an embodiment. FIGS. 2A and 2B are schematic sectional views showing a configuration of a cartridge according to a first embodiment. FIG. 2A shows a condition in which a developing roller and a photosensitive drum are in contact with each other, and FIG. 2B shows a condition in which the developing roller and the photosensitive drum are separated from each other.

As shown in FIG. 1, the image forming apparatus includes a laser optical apparatus 3 serving as an exposure device, a primary transfer apparatus 5, an intermediate transfer member 6, a secondary transfer apparatus 7, and a fixing apparatus 10. The image forming apparatus also includes a process cartridge (referred to hereafter simply as a cartridge) 11 that performs an image forming process and can be attached to and detached from an apparatus main body. As shown in FIGS. 2A and 2B, the cartridge 11 includes a photosensitive drum 1 serving as an image bearing member capable of bearing a latent image, a charging roller 2 serving as a charging device, a developing assembly 4, and a cleaning blade 9.

The photosensitive drum 1 is provided to be capable of rotating in a direction of an arrow r in FIGS. 2A and 2B, and a surface of the photosensitive drum 1 is charged to a uniform surface potential Vd by the charging roller 2 (a charging process). By emitting a laser beam from the laser optical apparatus 3, an electrostatic latent image is formed on the surface of the photosensitive drum 1 (an exposure process). Further, by supplying toner from the developing assembly 4 as a developer, the electrostatic latent image is visualized as a toner image serving as a developer image (a development process).

The visualized toner image on the photosensitive drum 1 (on the image bearing member) is transferred onto the intermediate transfer member 6 by the primary transfer apparatus 5, and then transferred onto a sheet 8 serving as a recording medium by the secondary transfer apparatus 7 (a transfer process). Here, untransferred toner that remains on the photosensitive drum 1 having not been transferred in the transfer process is scraped away by the cleaning blade 9 (a cleaning process). After the surface of the photosensitive drum 1 has been cleaned, the charging process, exposure process, development process, and transfer process described above are repeated. Meanwhile, the toner image transferred onto the sheet 8 is fixed by the fixing apparatus 10, whereupon the sheet 8 is discharged to the exterior of the image forming apparatus.

In the first embodiment, the apparatus main body is provided with four attachment portions to which the cartridge 11 is attached. Cartridges 11 filled respectively with yellow, magenta, cyan, and black toner are attached in order from an upstream side of a movement direction of the intermediate transfer member 6, and a color image is formed by transferring the toner in the respective colors in sequence onto the intermediate transfer member 6.

The photosensitive drum 1 is formed by laminating an organic photoreceptor coated sequentially with a positive charge injection prevention layer, a charge generation layer, and a charge transport layer onto an aluminum (Al) cylinder serving as a conductive substrate. Arylate is used as the charge transfer layer of the photosensitive drum 1, and a film thickness dP of the charge transport layer is regulated to 23 μm. The charge transport layer is formed by dissolving a charge transporting material into a solvent together with a binder. Examples of organic charge transporting materials include acryl resin, styrene resin, polyester, polycarbonate resin, polyarylate, polysulphone, polyphenylene oxide, epoxy resin, polyurethane resin, alkyd resin, and unsaturated resin. These charge transporting materials may be used singly or in combinations of two or more.

The charging roller 2 is formed by providing a semiconductive rubber layer on a core metal serving as a conductive support member. The charging roller 2 exhibits a resistance of approximately $10^5\Omega$ when a voltage of 200 V is applied to the conductive photosensitive drum 1.

As shown in FIGS. 2A and 2B, the developing assembly 4 includes a developer container 13 serving as a developer housing portion, a developing roller 14 serving as a developer carrying member capable of carrying toner, a supply roller 15, and a regulating blade 16 serving as a regulating member. Toner 12 serving as a developer is housed in the developer container 13. The developing roller 14 is provided to be capable of rotating in a direction of an arrow R in FIG. 2. The supply roller 15 supplies the toner 12 to the developing roller 14. The regulating blade 16 regulates the toner on the developing roller 14 (on the developer carrying member). Further, the supply roller 15 is provided to be capable of rotating while contacting the developing roller 14, and one end of the regulating blade 16 contacts the developing roller 14.

The supply roller 15 is configured by providing a urethane foam layer 15*b* around a core metal electrode 15*a* that has an outer diameter of ϕ 5.5 (mm) and serves as a conductive support member. An overall outer diameter of the supply roller 15, including the urethane foam layer 15*b*, is ϕ 13 (mm). A penetration level of the supply roller 15 relative to the developing roller 14 is 1.2 mm. In a contact region between the supply roller 15 and the developing roller 14, the supply roller 15 and the developing roller 14 rotate in directions having mutually opposite direction speeds. A powder pressure of the toner 12 existing on the periphery of the urethane foam layer 15*b* acts on the urethane foam layer 15*b*, and when the supply roller 15 rotates, the toner 12 is taken into the urethane foam layer 15*b*. The supply roller 15 containing the toner 12 supplies the toner 12 to the developing roller 14 in the contact region with the developing roller 14, and by rubbing against the toner 12, applies a preliminary triboelectric charging charge to the toner 12. Meanwhile, in a contact region (referred to hereafter as a developing nip portion) N between the photosensitive drum 1 and the developing roller 14, the supply roller 15 also serves to peel away the toner that remains on the developing roller 14 having not been supplied to the photosensitive drum 1.

As the developing roller 14 rotates, the toner 12 supplied to the developing roller 14 from the supply roller 15 reaches the regulating blade 16, where the toner 12 is regulated to a desired charge amount and a desired layer thickness. The regulating blade 16 is a stainless steel (SUS) blade having a thickness of 80 μm, and is disposed in a reverse orientation (in a counter direction) to the rotation of the developing roller 14. Further, a voltage is applied to the regulating blade 16 so that a potential difference of 200 V is generated relative to the developing roller 14. This potential difference is required to stabilize coating of the toner 12. A toner layer (a developer layer) formed on the developing roller 14 by the regulating blade 16 is conveyed to the developing nip portion N, and subjected to reversal development in the developing nip portion N.

Here, as shown in FIGS. 2A and 2B, the developing assembly 4 is capable of performing a contact/separation operation relative to the photosensitive drum 1. More specifically, the developing assembly 4 is provided to be capable of moving between a contact position A (a position indicated by dotted lines in FIGS. 2A and 2B) contacting the photosensitive drum 1 and a separation position B (a position indicated by solid lines in FIG. 2B) separated from the photosensitive drum 1 (i.e. to be capable of contacting and separating from the photosensitive drum 1). When image formation is not underway, the developing assembly 4 is adjusted appropriately so as to separate from the photosensitive drum 1 to prevent the toner 12 from rubbing against the photosensitive drum 1 such that the toner 12 deteriorates and the photosensitive drum 1 becomes worn.

In the contact position A, the penetration level of the developing roller 14 relative to the photosensitive drum 1 is set at 40 μm by a roller, not shown in the drawings, provided on an end portion of the developing roller 14. Further, in the developing nip portion N where the developing roller 14 contacts the photosensitive drum 1, the developing roller 14 rotates in an identical direction (the R direction) to the rotation direction (the r direction) of the photosensitive drum 1 at a circumferential speed ratio of 117% relative to the photosensitive drum 1. In other words, the photosensitive drum 1 is provided to be capable of rotating such that a surface movement direction thereof in the developing nip portion N is identical to the developing roller 14, while the developing roller 14 rotates at a higher rotation speed than the photosensitive drum 1. This circumferential speed difference is provided in order to apply a shearing force to the toner, thereby reducing a substantive attachment force thereof so that controllability by means of an electric field is improved. A width of the developing nip portion N (a length in the rotation direction of the developing roller 14) at this time is 1.1 mm.

Furthermore, as shown in FIG. 2B, the image forming apparatus includes voltage applying devices 17, 18, and voltages are applied to the developing roller 14, the supply roller 15, and the regulating blade 16 from the voltage applying devices 17, 18.

Specific voltages constituting the first embodiment will now be described. By applying −1050 V to the charging roller 2, the surface of the photosensitive drum 1 is charged uniformly to −500 V, and as a result, a dark potential Vd is formed. A potential (a light potential Vl) of an image portion in which an image is formed is adjusted to −100 V by the laser optical apparatus 3. By applying a voltage of −300 V to the developing roller 14 at this time, the negative polarity toner is transferred to the image portion (the region of the light potential Vl), whereby reversal development is performed. Further, |Vd−Vdc| will be referred to as Vback, and Vback is set as 200 V.

In the first embodiment, single component, non-magnetic toner is used as the toner 12 serving as the developer. The toner 12 is adjusted so as to contain a binder resin and a charge control agent, and manufactured to have negative polarity by adding a fluidizing agent or the like thereto as an external additive. Furthermore, the toner 12 is manufactured using a polymerization method, and regulated to an average particle size of approximately 5 μm.

Further, an amount of toner charged into the developer container 13 of the developing assembly 4 is set at an amount enabling printing of 3000 sheets of a converted image having an image ratio of 5%. An image formed by repeatedly printing one dot line and leaving nineteen dot lines unprinted may be cited as a specific example of horizontal lines having an image ratio of 5%.

During the image forming process, the photosensitive drum 1 performs an operation in a first mode, in which the photosensitive drum 1 is driven to rotate by the image forming apparatus at a rotation speed (a first rotation speed) of 240 mm/sec in the direction of the arrow r in the drawings. Further, the image forming apparatus according to this embodiment includes a low speed mode (a second mode) in which the process speed is set at 60 mm/sec (a second speed), which is lower than the first speed, in order to secure an amount of heat required to perform fixing during passage of a thick recording sheet (a thick sheet). Note that in this embodiment, operations are performed in only two process modes (a large mode and the second mode), but depending on the thickness of the recording sheet and so on, a plurality of process modes may be provided so that control corresponding to the respective process modes can be executed.

<<Second Embodiment>>

Figure 4:
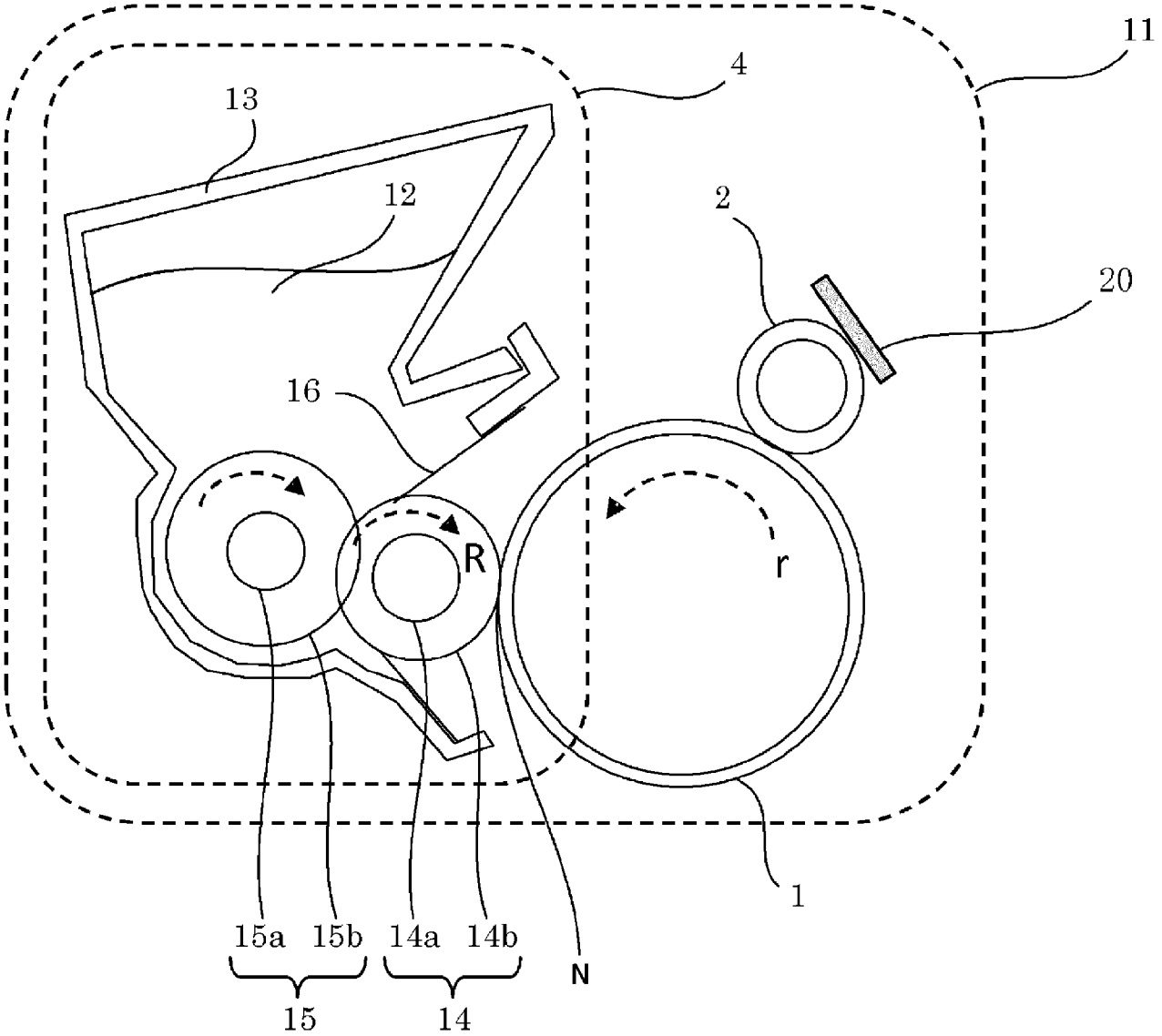
FIG. 4 is a schematic sectional view showing a configuration of a cartridge according to a second embodiment.

Next, referring to FIG. 4, a second embodiment will be described. FIG. 4 is a schematic sectional view showing a configuration of a cartridge according to the second embodiment. An image forming apparatus according to the second embodiment is a laser printer that uses a transfer type electrophotographic process and includes a toner recycling process (a cleanerless system). Duplicate description of points that are identical to the image forming apparatus of the first embodiment, described above, has been omitted, and only differences will be described below. The main difference with the first embodiment of the present invention is that the cleaning blade 9 that cleans the photosensitive drum is omitted, and the untransferred toner is recycled. The untransferred toner is circulated so as not to adversely affect the other processes such as charging, and collected in the developing assembly 4. More specifically, the configuration of the first embodiment is modified as follows.

As regards charging, a similar charging roller to the charging roller 2 of the first embodiment is used, but a charging roller contact member 20 is provided with the aim of preventing the charging roller 2 from being soiled by toner. A 100 μm polyimide film is used as the charging roller contact member 20, and the polyimide film contacts the charging roller 2 at a linear pressure of no more than 10 (N/m). Polyimide is used because it possesses a triboelectric charging characteristic for applying a negative charge to the toner. Even when the charging roller 2 is soiled by toner having a reverse polarity (positive polarity) to the charging polarity thereof, the charging roller contact member 20 switches the charge of the toner from positive to negative so that the charging roller 2 can expel the toner quickly and the expelled toner can be collected in the developing assembly 4.

Further, to improve the toner collecting performance of the developing assembly 4, an absolute value of the dark potential Vd and the value of Vback were set to be large. More specifically, the surface of the photosensitive drum 1 is set at a uniform surface potential Vd of −800 V by setting the voltage applied to the charging roller 2 at −1350 V. Furthermore, Vback is set at 500 V by setting a developing bias at −300 V.

<Manufacture of Developing Roller>

A method of manufacturing the developing roller 14 (developing rollers A to E) and so on will be described below using examples and comparative examples. Configurations obtained by applying a developing roller A, a developing roller B, a developing roller C, and a developing roller E to the configuration of the image forming apparatus according to the first embodiment will be referred to as a first example, a first comparative example, a second comparative example, and a second example, respectively. Further, configurations obtained by applying the developing roller A, the developing roller B, the developing roller C, and the developing roller E to the configuration of the image forming apparatus according to the second embodiment will be referred to as a third example, a third comparative example, a fourth comparative example, and a fourth example, respectively.

(Manufacture of Developing Roller A)

The developing roller A used in the first and third examples was manufactured as follows. A silicon rubber layer 14*b* serving as a conductive base layer containing a conductive agent was provided on a periphery of a core metal electrode 14*a* having an outer diameter of ϕ 6 (mm) and serving as a conductive support member. A surface layer of the silicon rubber layer 14*b* was coated with 10 μm of urethane resin through which roughening particles and a conductive agent were dispersed, whereby an overall outer diameter of the developing roller A was set at ϕ 11.5 (mm). Furthermore, an Al203 (aluminum oxide) layer of 100 nm was provided as a surface layer by electron beam deposition. When the silicon rubber layer, the urethane resin, and the Al203 layer were cut out integrally and 200 V was applied thereto in a thickness direction, a resistance of the developing roller A was approximately $10^9$ Ωcm$^2$. Further, a volume resistance ρc of the Al203 layer (the surface layer) was approximately $10^{14}$ Ωcm.

(Manufacture of Developing Roller B)

The developing roller B used in the first and third comparative examples was manufactured as follows. The conductive silicon rubber layer 14*b* containing a conductive agent was provided on the periphery of the core metal electrode 14*a* having an outer diameter of ϕ 6 (mm) and serving as the conductive support member. The surface layer of the silicon rubber layer 14*b* was coated with 10 μm of urethane resin through which roughening particles and a conductive agent were dispersed to form the surface layer, whereby the overall outer diameter of the developing roller B was set at ϕ 11.5 (mm). When the silicon rubber layer and the urethane resin were cut out integrally and 200 V was applied thereto in the thickness direction, the resistance of the developing roller B was approximately $10^6$ Ωcm$^2$. Further, the volume resistance ρc of the urethane layer was approximately $10^8$ Ωcm.

(Manufacture of Developing Roller C)

The developing roller C used in the second and fourth comparative examples was manufactured as follows with the aim of increasing an average volume resistance relative to the developing roller B. In the developing roller C, the conductive silicon rubber layer 14*b* containing a conductive agent was provided on the periphery of the core metal electrode 14*a* having an outer diameter of ϕ 6 (mm) and serving as the conductive support member. The surface layer of the silicon rubber layer 14*b* was coated with 10 μm of urethane resin through which roughening particles and a conductive agent were not dispersed to form the surface layer, whereby the overall outer diameter of the developing roller C was set at ϕ 11.5 (mm). When the silicon rubber layer and the urethane resin were cut out integrally and 200 V was applied thereto in the thickness direction, the resistance of the developing roller C was approximately $10^7$ Ωcm$^2$. Further, the volume resistance ρc of the urethane was approximately $10^{10}$ Ωcm.

(Manufacture of Developing Roller D)

The developing roller D was manufactured as follows. The conductive silicon rubber layer 14*b* containing a conductive agent was provided on the periphery of the core metal electrode 14*a* having an outer diameter of ϕ 6 (mm) and serving as the conductive support member. The surface layer of the silicon rubber layer 14*b* was coated with 10 μm of urethane resin through which roughening particles and a conductive agent are dispersed, whereby the overall outer diameter of the developing roller D was set at ϕ 11.5 (mm). Furthermore, an Al203 film of 1 μm was provided as the surface layer by electron beam deposition. When the silicon rubber layer, the urethane resin, and the Al203 film were cut out integrally and 200 V was applied thereto in the thickness direction, the resistance of the developing roller D was approximately $10^{10}$ Ωcm$^2$. Further, the volume resistance ρc of the Al203 film was approximately $10^{14}$ Ωcm. The developing roller D is an example in which the film thickness of the Al203 layer provided on the developing roller A used in the first and third examples is increased to 1 μm.

(Manufacture of Developing Roller E)

The developing roller E used in the second and fourth examples was manufactured as follows. The conductive silicon rubber layer 14*b* containing a conductive agent was provided on the periphery of the core metal electrode 14*a* having an outer diameter of ϕ 6 (mm) and serving as the conductive support member. The surface layer of the silicon rubber layer 14*b* was coated with 10 μm of urethane resin through which roughening particles and a conductive agent are dispersed, whereby the overall outer diameter of the developing roller E was set at ϕ 11.5 (mm). Furthermore, an Al203 film of 200 nm was provided as the surface layer by electron beam deposition. Moreover, the developing roller E was heated for 30 minutes at 150° C. When the silicon rubber layer, the urethane resin, and the Al203 film were cut out integrally and 200 V was applied thereto in the thickness direction, the resistance of the developing roller E was approximately $10^{10}$ $\Omega cm^2$. Further, the volume resistance ρc of the Al203 film was approximately $3.0\times10^{14}$ Ωcm.

Note that the surface layer is the outermost layer formed on the surface of the developing roller 14, i.e. the layer that contacts the toner. According to the present invention, as long as the internal structure other than the outermost layer is constituted by at least one layer, similar effects can be obtained. In these examples, aluminum oxide was used as the surface layer, but the surface layer may be formed using a type of alumina other than aluminum oxide. The alumina is an aluminum oxide such as α alumina or γ alumina, an aluminum oxide hydrate such as Boehmite or pseudo-Boehmite, aluminum hydrate, or an aluminum compound obtained by subjecting aluminum alkoxide to hydrolysis and a condensation reaction.

<First Example>

The first example employing the developing roller A in the cartridge configured as described in the first embodiment will now be described in detail. The inventors discovered through committed research that when a relationship shown below in (Equation 1) is established, an amount of fog is suppressed dramatically. Note that fog is an image defect appearing as scumming when the toner charge decays or the polarity of the toner reverses in the developing nip portion N where the photosensitive drum 1 contacts the developing roller A such that a small amount of toner is developed in the non-image portion (an unexposed portion) where printing is not intended. The amount of fog is an amount of toner transferred onto the photosensitive drum 1 due to the occurrence of fog.

[Math. 1]

$$\left|\frac{VT}{\rho_c d_c}\right| \leq \left|\frac{q}{s}\right| \quad \text{(Equation 1)}$$

Here, ρc is the volume resistance of the surface layer of the developing roller, and dc is the film thickness of the surface layer. Further, T is a time required for the toner entering the developing nip portion N, i.e. the contact region between the developing roller A and the photosensitive drum 1, to pass through the developing nip portion N as the developing roller A rotates. The image forming apparatus according to the first embodiment includes two modes (the first mode and the second mode) having respective process speeds of 240 mm/sec (the first speed) and 60 mm/sec (the second speed). Taking into account the aforesaid circumferential speed ratio and the width (1.1 mm) of the developing nip portion N, the toner passage time T is 3.91 msec and 15.7 msec in the respective modes. Furthermore, V is a surface potential of the photosensitive drum 1 in the developing nip portion N when the photosensitive drum 1 and the developing roller carrying the toner contact each other. In other words, V is an effective voltage that is essentially applied to the toner layer when the photosensitive drum 1 and the developing roller A are adjacent to each other via the toner layer 12. The effective voltage V will be described in detail below.

Further, q/s is an average surface charge density of the toner forming the toner layer immediately before the toner layer on the developing roller contacts the photosensitive drum 1. The average surface charge density is measured using an E-spart analyzer, manufactured by Hosokawa Micron Group, by measuring the surface charge density of 3000 individual toner samples 12 and calculating an average value thereof. In the first example, the average surface charge density of the toner was −32 $\mu C/m^2$. The average surface charge density of the toner was measured after leaving the image forming apparatus for 24 hours following a printing operation in which 100 sheets were printed in a test environment of 30° C. and 80% RH. Note that this printing test was performed by continuously passing sheets printed with a recorded image of horizontal lines having an image ratio of 5%. Here, an image formed by repeatedly printing one dot line and leaving nineteen dot lines unprinted was used as the horizontal line image having an image ratio of 5%.

Figure 13A:
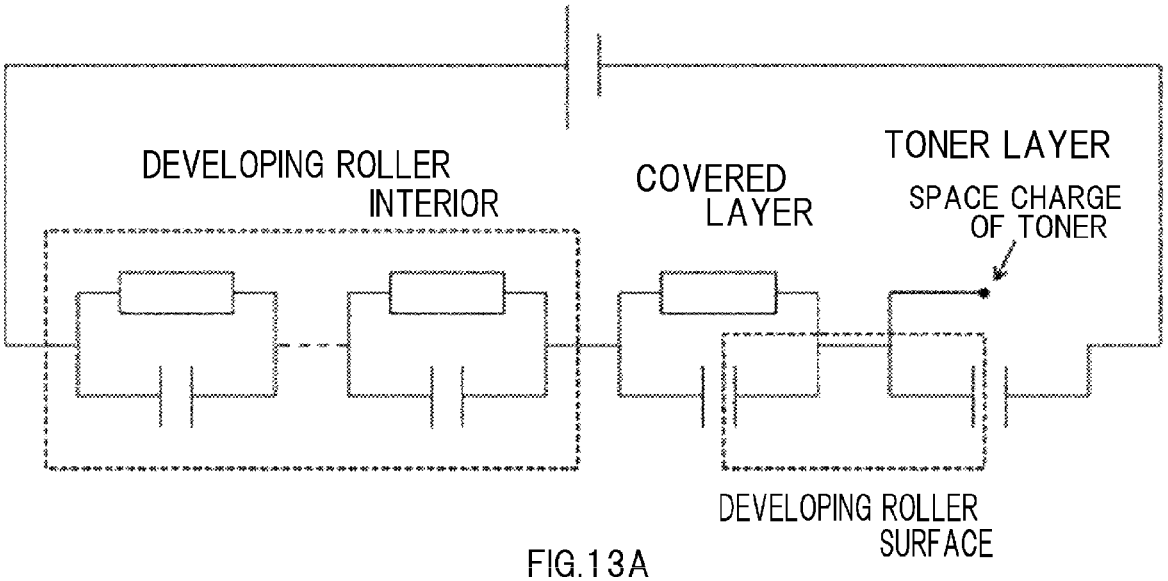
FIGS. 13A and 13B are pattern diagrams showing an equivalent circuit of a developing roller interior and a developing roller surface.
Figure 13B:
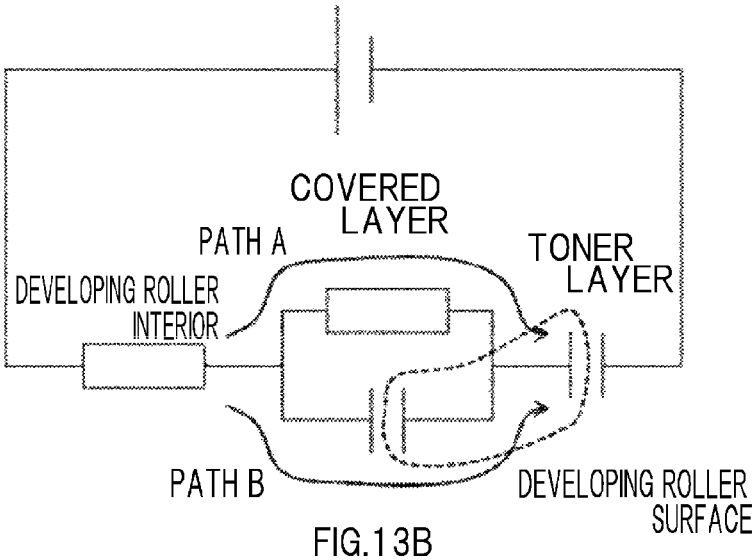

Next, referring to FIG. 13, a physical significance of (Equation 1) will be described. FIG. 13 is a pattern diagram showing an equivalent circuit of the developing roller interior and the developing roller surface (the surface layer of the developing roller and the toner layer on the developing roller surface). FIG. 13A shows an equivalent circuit of the developing roller interior and the developing roller surface, and FIG. 13B shows an equivalent circuit approximating the equivalent circuit shown in FIG. 13A. Note that here, the developing roller surface denotes the surface layer of the developing roller and the toner layer on the surface layer, while the developing roller interior denotes the part of the developing roller excluding the surface layer.

A schematic equivalent circuit of the developing roller interior, the surface layer of the developing roller, and the toner layer on the developing roller surface, and a reaction obtained when a voltage is applied thereto, will now be considered. The developing roller interior can be represented by a parallel circuit of a resistance and a capacitor, and when the developing roller interior is formed from multiple layers, the developing roller interior can also be represented by series circuits of the multiple layers. FIG. 13A shows a case in which the developing roller interior is formed from two layers.

The surface layer of the developing roller is likewise represented by a parallel circuit of a resistance and a capacitor, which is connected in series to the developing roller interior. The toner layer includes a capacitor, but a component corresponding to a parallel resistance thereto exhibits complex behavior and cannot be represented by a simple equivalent circuit. The reason for this is that the toner possesses a space charge, and the space charge is a component that interacts with the developing roller surface electrically such that a current is caused to flow. This interaction is considered to be determined by a density at which an empty level that recombines with the space charge is formed on the developing roller surface per unit surface area of the toner. In other words, the phenomenon of toner charge decay is believed to be determined by the amount of charge that flows into the developing roller surface, surrounded by a dotted line in FIG. 13A, through the equivalent circuit described above.

To ease this problem, the equivalent circuit described above is replaced by the approximate equivalent circuit shown in FIG. 13B. First, the developing roller interior is conductive, and is therefore easily replaced with a simple resistance. Next, the toner layer applies a current in accordance with the amount of charge on the developing roller surface, and therefore the component corresponding to the resistance of the toner layer is removed and replaced with a simple capacitor. The current of the toner layer, or in other words the decay of the toner charge amount, can then be expressed by comparing the toner charge amount with the amount of charge flowing through the developing roller surface sandwiched between the capacitor of the toner layer and the capacitor of the surface layer. The charge amount of the developing roller surface and the charge amount of the toner are preferably considered as a surface charge density per unit area. The reason for this is that the toner has a property whereby it does not apply a current while not rotating but applies a current and so on while rotating, in other words, a property of exchanging a charge by directly contacting a terminal to which the space charge on the surface is connected.

Next, referring to FIG. 13B, a path A along which the charge passes through the resistance side of the surface layer and a path B along which the charge passes through the capacitor side will be considered. The charge flowing along the path B is shared by the surface layer and the toner layer such that the charge amount thereof varies. However, the total amount of the charge on the developing roller surface does not vary. Hence, the charge passing along the path B does not cause the toner charge to decay.

The charge amount on the developing roller surface is varied by the charge flowing along the path A. The charge amount flowing along the path A is affected by the capacitor of the surface layer and the toner layer, and reaches a maximum when the capacitor of the surface layer is eliminated such that the capacitor of the toner layer is short-circuited. At this time, since the resistance of the developing roller interior is small, the resistance of the surface layer controls all electrical conduction.

When the volume resistance of the surface layer is set as ρc and the film thickness is set as dc, the resistance per unit area is ρcdc. In consideration of the condition on which the charge amount flowing along the path A reaches the maximum, as described above, the entire effective voltage V is applied as is to the surface layer. A current density at this time is V/ρcdc. Further, since a reduction in the current occurring during charging of the capacitor is not considered, the charge amount flowing into the developing roller surface along the path A is set as VT/ρcdc, where T is an application time of an electrical field.

Hence, the left side of (Equation 1) shows the charge density flowing into the developing roller surface, and the right side shows the surface charge density of the toner. In other words, (Equation 1) expresses a condition on which to set the charge density of the developing roller surface at or below the surface charge density of the toner by comparing the charge density of the developing roller surface with the surface charge density of the toner.

When the value of the surface charge density is large, this means that a large amount of charge exists on the toner surface, and that the charges are formed densely. When the value is small, on the other hand, this means that the charge amount is small, and that charges are formed on the surface sparsely and are separated from each other.

Figures 6A, 6B:
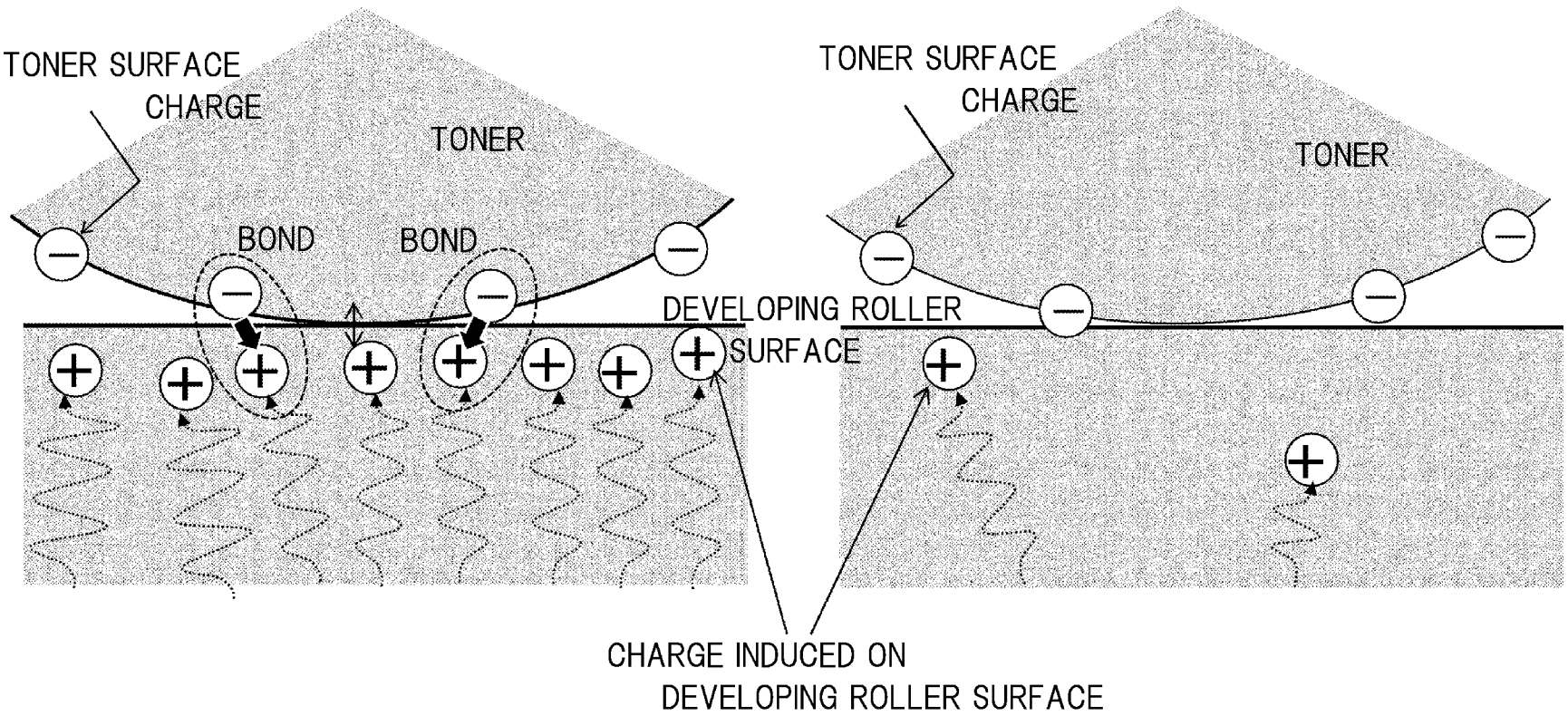
FIGS. 6A and 6B are pattern diagrams illustrating decay of a toner charge.

Referring to FIG. 6, a mechanism by which toner charge decay can be suppressed when the relationship of (Equation 1) is satisfied will be described. FIG. 6 is a pattern diagram illustrating toner charge decay. FIG. 6A shows a condition in which the density of the charge induced on the developing roller surface is larger than the surface charge density of the toner, and FIG. 6B shows a condition in which the density of the charge induced on the developing roller surface is smaller than the surface charge density of the toner.

As shown in FIG. 6A, when the density of the charge induced on the developing roller surface is larger than the surface charge density of the toner, the charge (negative polarity) on the toner surface contacts the reverse polarity (positive polarity) charge induced on the developing roller in the developing nip portion N such that a probability of recombination is high. In other words, the charge existing on the toner surface is zero, and therefore the toner charge is likely to decay.

As shown in FIG. 6B, on the other hand, when the density of the charge induced on the developing roller surface is smaller than the surface charge density of the toner, the probability of contact between the charge on the toner surface and the reverse polarity charge induced on the developing roller surface in the developing nip portion N is low, and therefore recombination is unlikely. In other words, toner charge decay can be suppressed dramatically.

It is evident, therefore, that when the surface charge density of the developing roller 14 is set at or below the surface charge density of the toner 12, decay of the toner charge is suppressed.

Figure 12A:
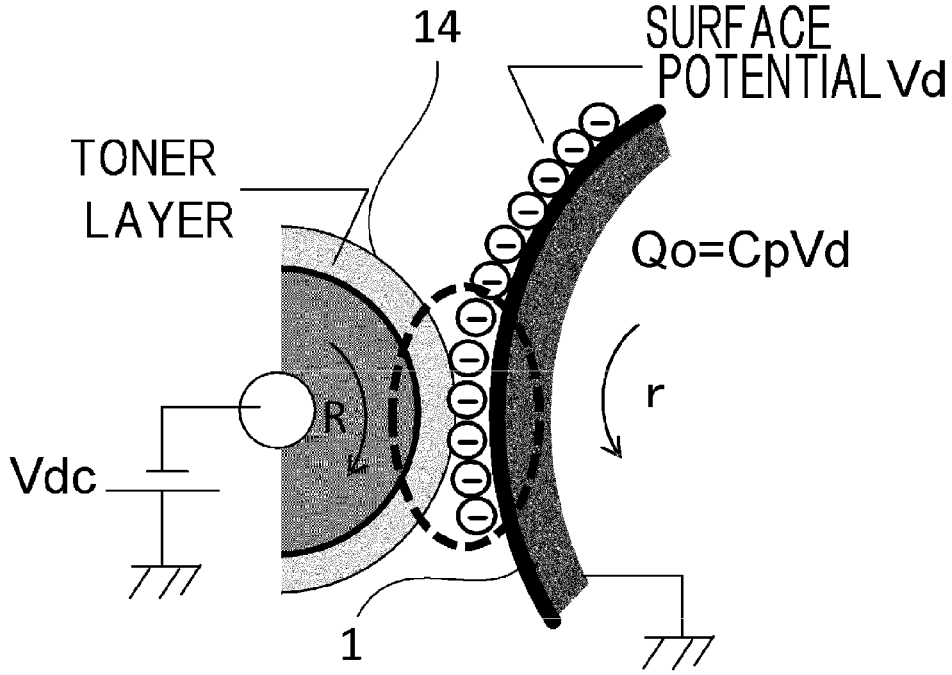
FIGS. 12A and 12B are pattern diagrams illustrating an effective voltage applied to a toner layer.
Figure 12B:
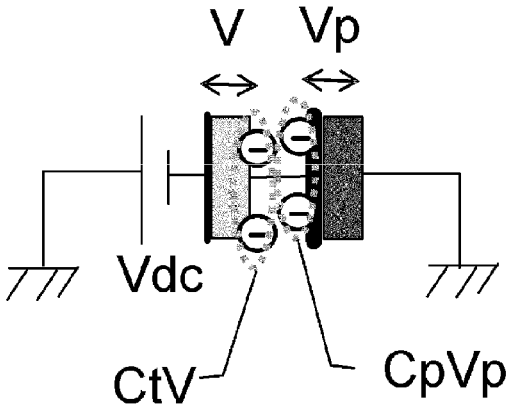

Next, using FIG. 12, the effective voltage V effectively applied to the toner layer will be described. FIG. 12 is a pattern diagram illustrating the effective voltage applied to the toner layer. FIG. 12A is a schematic view showing the vicinity of the developing nip portion, and FIG. 12B is a pattern diagram illustrating the developing roller and a charge amount Q0 held on the photosensitive drum surface. The charge amount Q0 held on the surface of the photosensitive drum 1 when not in contact with the developing roller is expressed by (Equation 2), shown below, using a capacitance Cp of the photosensitive drum 1 and the dark potential Vd of the photosensitive drum 1.

[Math. 2]

$$Q_0 = C_p \cdot V_d \qquad \text{(Equation 2)}$$

Meanwhile, a potential Vp on the photosensitive drum 1 when the developing roller contacts the photosensitive drum 1 is expressed by (Equation 3), shown below, using the effective voltage V effectively applied to the toner layer, and a development voltage Vdc. As is evident from this equation, the effective voltage V is a potential difference between the potential Vp on the photosensitive drum 1 and the surface potential Vdc of the developing roller 14.

[Math. 3]

$$V_p = V + V_{dc} \qquad \text{(Equation 3)}$$

Further, since charge amounts before and after the photosensitive drum 1 and the developing roller A come into contact are held, the charge amount Q0 is expressed by (Equation 4), shown below, using the capacitance Cp of the photosensitive drum 1 and a capacitance Ct of the toner layer.

[Math. 4]

$$Q_0 = C_p \cdot V_p + C_t \cdot V \qquad \text{(Equation 4)}$$

Since the relationship of Vback=Vd−Vdc is established, as described above, a relationship of (Equation 5), shown below, is established using (Equation 2) to (Equation 4).

[Math. 5]

$$V = \frac{C_p}{C_p + C_t} V_{back} \quad \text{(Equation 5)}$$

Here, partial pressure of dielectrics sandwiching the space charge may be considered. When an arbitrary surface area is set as S, a dielectric constant of a vacuum is ∈0, a relative dielectric constant of the charge transport layer is ∈P, the film thickness is dP, a relative dielectric constant of the toner layer is ∈t, and the layer thickness is dt, Cp is expressed by (Equation 6), shown below, and Ct is expressed by (Equation 7), shown below. Strictly, the capacitance of the surface layer should also be taken into account, but since the surface layer has a sufficiently lower resistance than the toner and the photosensitive drum, the capacitance thereof can be ignored.

[Math. 6]

$$C_p = \varepsilon_p \varepsilon_0 \frac{S}{d_p} \quad \text{(Equation 6)}$$

$$C_t = \varepsilon_t \varepsilon_0 \frac{S}{d_t} \quad \text{(Equation 7)}$$

The respective relative dielectric constants were determined from impedance measurements obtained using a 1260 type impedance analyzer and a 1296 type impedance analyzer, manufactured by Solartron. In this example, EP was 2, Et was 3, the film thickness dP of the photosensitive drum 1 was 23 μm, and the toner layer thickness dt was 10 μm. Here, the toner layer thickness dt was obtained by measuring a difference between a part coated with toner and a part not coated with toner at 10 lengthwise points, and calculating an average value thereof. Accordingly, Cp/(Ct+Cp)=(∈P/dP)/(∈t/dt+∈P/dt)=0.40, whereby the effective voltage V took a value of approximately 40% of Vback.

(Equation 5) shows that since Cp/(Ct+Cp) does not take a larger value than 1, the effective voltage V takes a smaller value than Vback. As the number of printed sheets increases, the photosensitive drum 1 becomes worn, and as the film thickness thereof decreases as a result, the capacitance Cp of the photosensitive drum 1 increases, leading to a reduction in the effect of the toner layer. In other words, the effective voltage V takes a value that is closer to Vback. In order to reduce the effective voltage V, the film thickness of the photosensitive drum 1 is preferably increased. Meanwhile, the effective voltage V also varies in response to variation in the toner layer thickness. In other words, the effective voltage V does not exceed Vback even when the photosensitive drum 1 and the toner layer voltage vary, and therefore, when (Equation 8), shown below, is satisfied using Vback instead of the effective voltage V of (Equation 1), it is believed that toner charge decay can be suppressed with stability over time.

[Math. 7]

$$\left|\frac{V_{back} T}{\rho_c d_c}\right| < \left|\frac{q}{s}\right| \quad \text{(Equation 8)}$$

Here, respective values employed in the first example are shown on Table 1.

TABLE 1

| Toner layer thickness $d_t$(μm) | Toner layer relative dielectric constant $\in_t$ | Charge transport layer film thickness $d_p$(μm) | Charge transport layer relative dielectric constant $\in_p$ | Circumferential speed (mm/s) at low speed | Circumferential speed ratio (%) | Developing nip width (mm) | Nip width passage time T(ms) |
|---|---|---|---|---|---|---|---|
| 10 | 2 | 23 | 3 | 60 | 117 | 1.1 | 15.9 |

Furthermore, to verify a relationship between the likelihood of toner charge decay and (Equation 1), a test was performed using the developing roller C having a larger average resistance than the developing roller B. First, the amount of fog was measured. A following method of evaluating the amount of fog was employed.

An image forming operation of the image forming apparatus was stopped during printing of a solid white image. Toner existing on the photosensitive drum 1 after the developing process and before the transfer process was transferred onto transparent tape, whereupon the tape carrying the toner was adhered to a recording sheet or the like. Moreover, the tape which did not carry the toner was simultaneously adhered to the same recording sheet. An optical reflectance through a green filter was measured from above the tape adhered to the recording sheet using an optical reflectance gauge (TC-6DS, manufactured by Tokyo Denshoku), and an amount of reflectance corresponding to fog was determined by subtracting the measured optical reflectance from a reflectance of the tape without the toner. The result was evaluated as the amount of fog. The amount of fog was measured at three or more points on the tape, and an average value thereof was determined.

The fog evaluation was performed after leaving the image forming apparatus for 24 hours following a printing operation in which 100 sheets were printed in a test environment of 30° C. and 80% RH. The printing test was performed by continuously passing sheets printed with a recorded image of horizontal lines having an image ratio of 5%. Here, an image formed by repeatedly printing one dot line and leaving nineteen dot lines unprinted was used as the horizontal line image having an image ratio of 5%.

Figure 3:
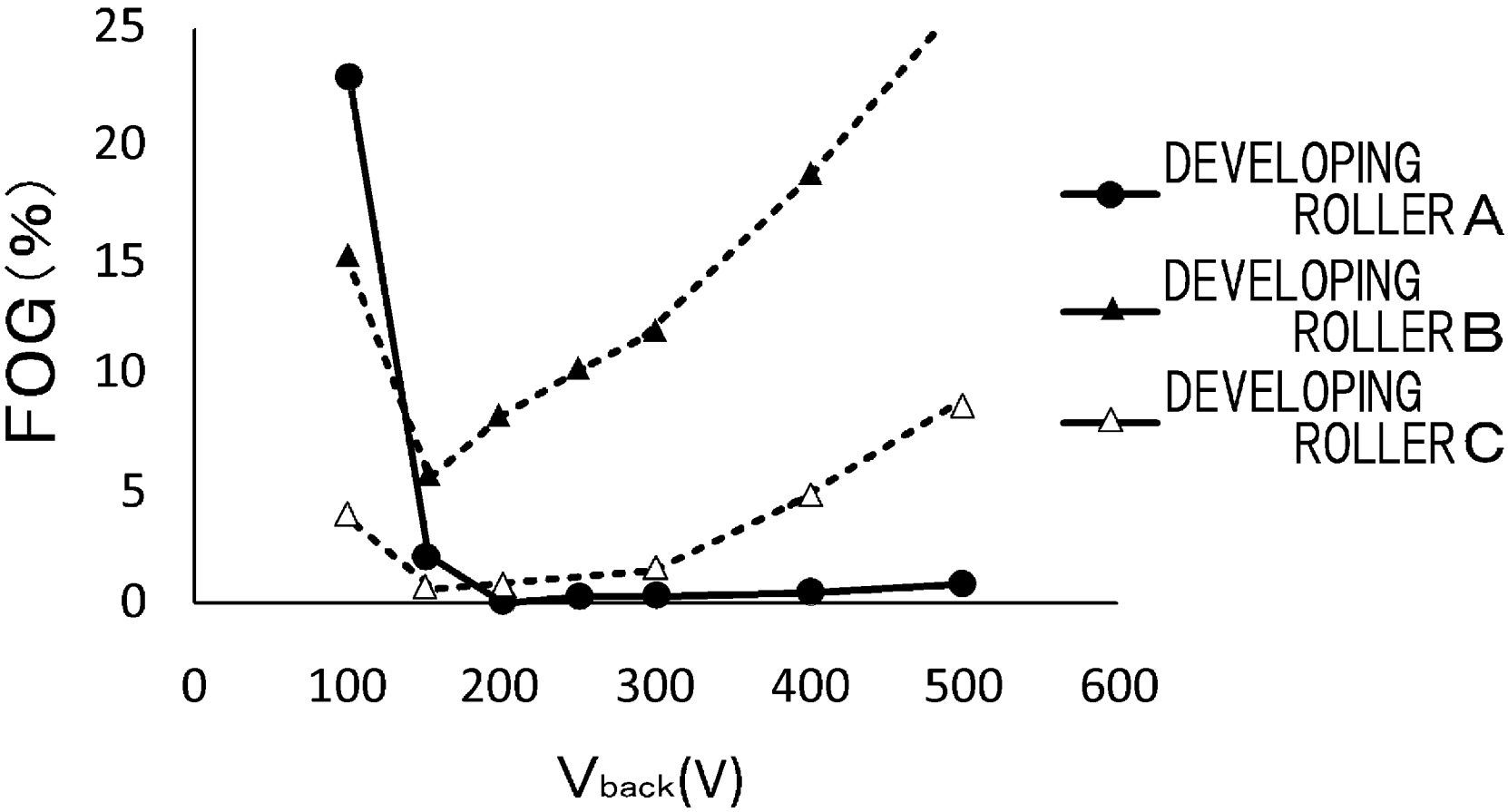
FIG. 3 is a graph showing a relationship between fog and Vback.

A relationship between fog (%) and Vback will now be described using FIG. 3. FIG. 3 is a graph showing a relationship between Vback and amounts of fog obtained with the developing rollers A, B, and C. Here, the value of Vback (=Vd−Vdc) was adjusted by modifying the voltage Vdc applied to the developing roller. It can be seen from FIG. 3 that the amount of fog obtained with the developing rollers B and C increases steadily as the value of Vback increases.

Figure 5:
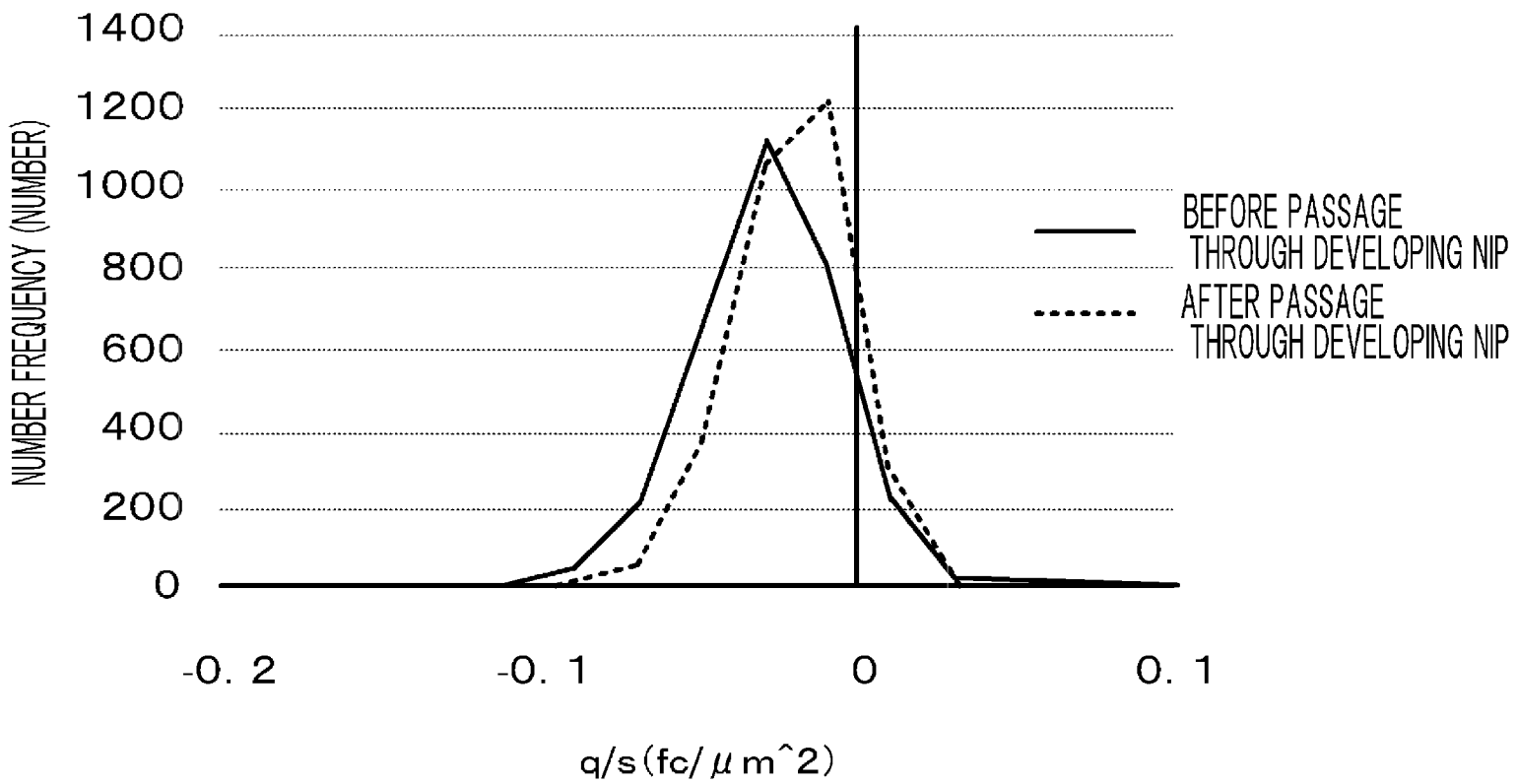
FIG. 5 is a graph comparing a surface charge density of toner before and after passage through a developing nip portion.

FIG. 5 is a graph comparing the surface charge density q/s of the toner before and after passing through the developing nip portion of the developing roller C when Vback=500 V. The ordinate of FIG. 5 shows the number of toner samples taking a corresponding value of the charge density shown on the abscissa. In this example, 3000 toner samples were measured. As is evident from FIG. 5, it was confirmed that the surface charge density q/s of the toner 12 on the developing roller 14 decays as the toner 12 passes through the developing nip portion N. As a result, fog is promoted.

Next, to verify a relationship between (Equation 1) and an amount of toner charge decay, a relationship between a ratio of the surface charge density of the developing roller to the surface charge density of the toner and a decay rate (a q/s decay rate) of the surface charge density of the toner was investigated. The q/s decay rate is obtained by dividing a difference between q/s prior to passage through the developing nip portion N and q/s following passage through the developing nip portion N by q/s prior to passage through the developing nip portion N.

[Math. 8]

$$\left|\frac{VT}{\rho_c d_c}\right| / \left|\frac{q}{s}\right| \quad \text{(Equation 9)}$$

(Equation 9) satisfies (Equation 1) when a value equal to or smaller than 1 is obtained, is satisfied, and is outside the range of (Equation 1) when a value larger than 1 is obtained. As regards unvarying parameters employed in the following verification, the effective voltage V was fixed at 200 V, the passage time T through the developing nip portion N was fixed at 19.6 msec (4.6 msec with respect to level fluctuation (q/s fluctuation) in the value of q/s, shown in FIG. 8B), and the film thickness dc of the surface layer was fixed at 10 μm.

Figure 8A:
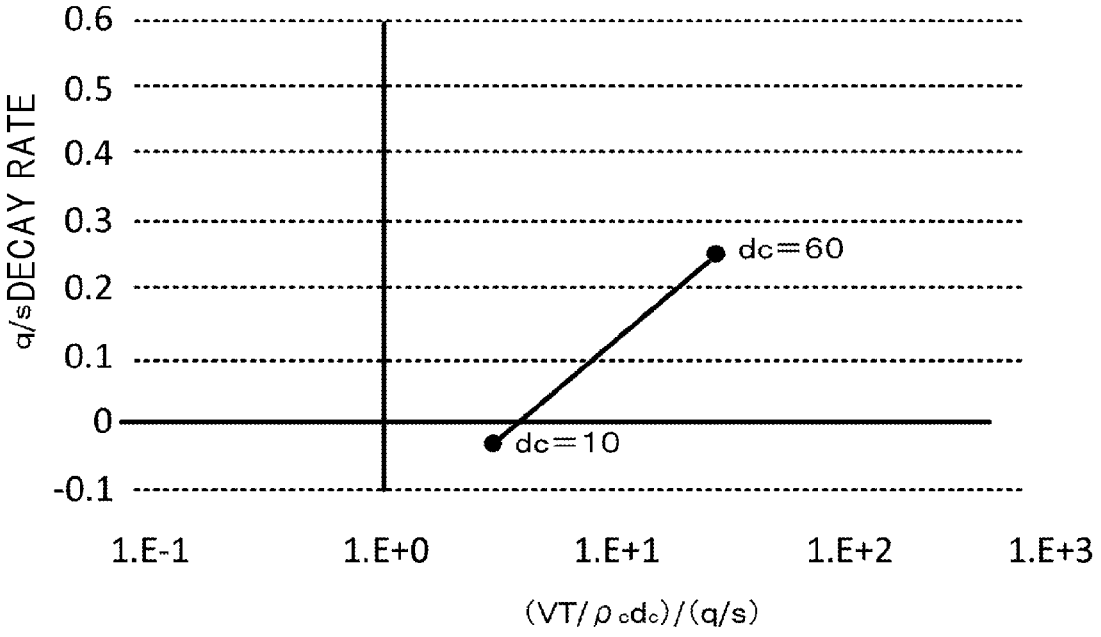
FIGS. 8A and 8B are graphs illustrating the q/s decay.
Figure 8B:
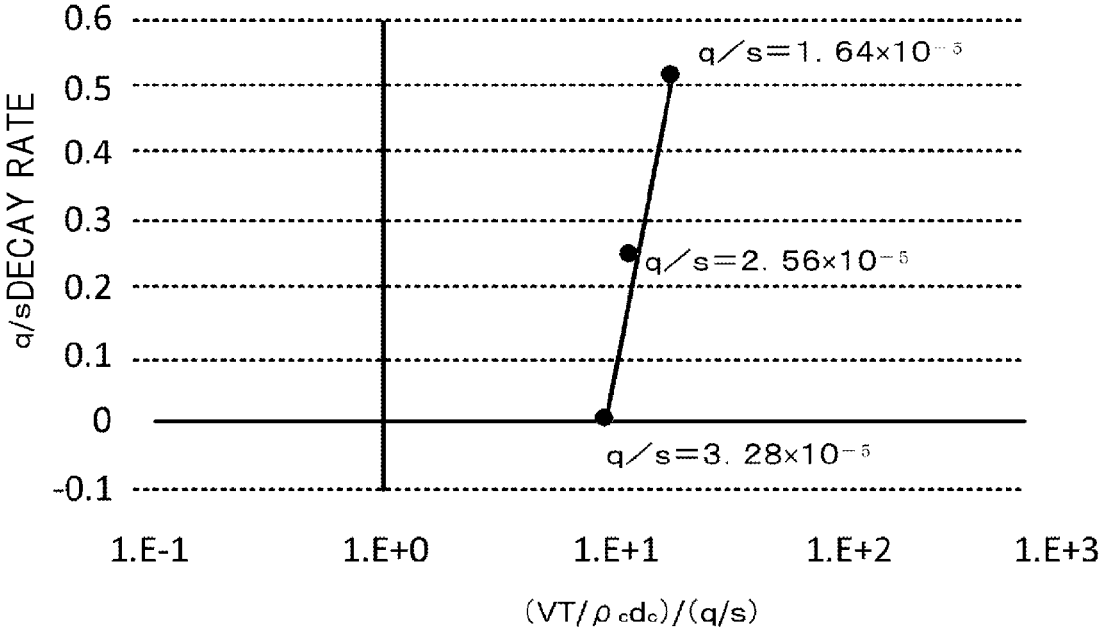
Figure 9:
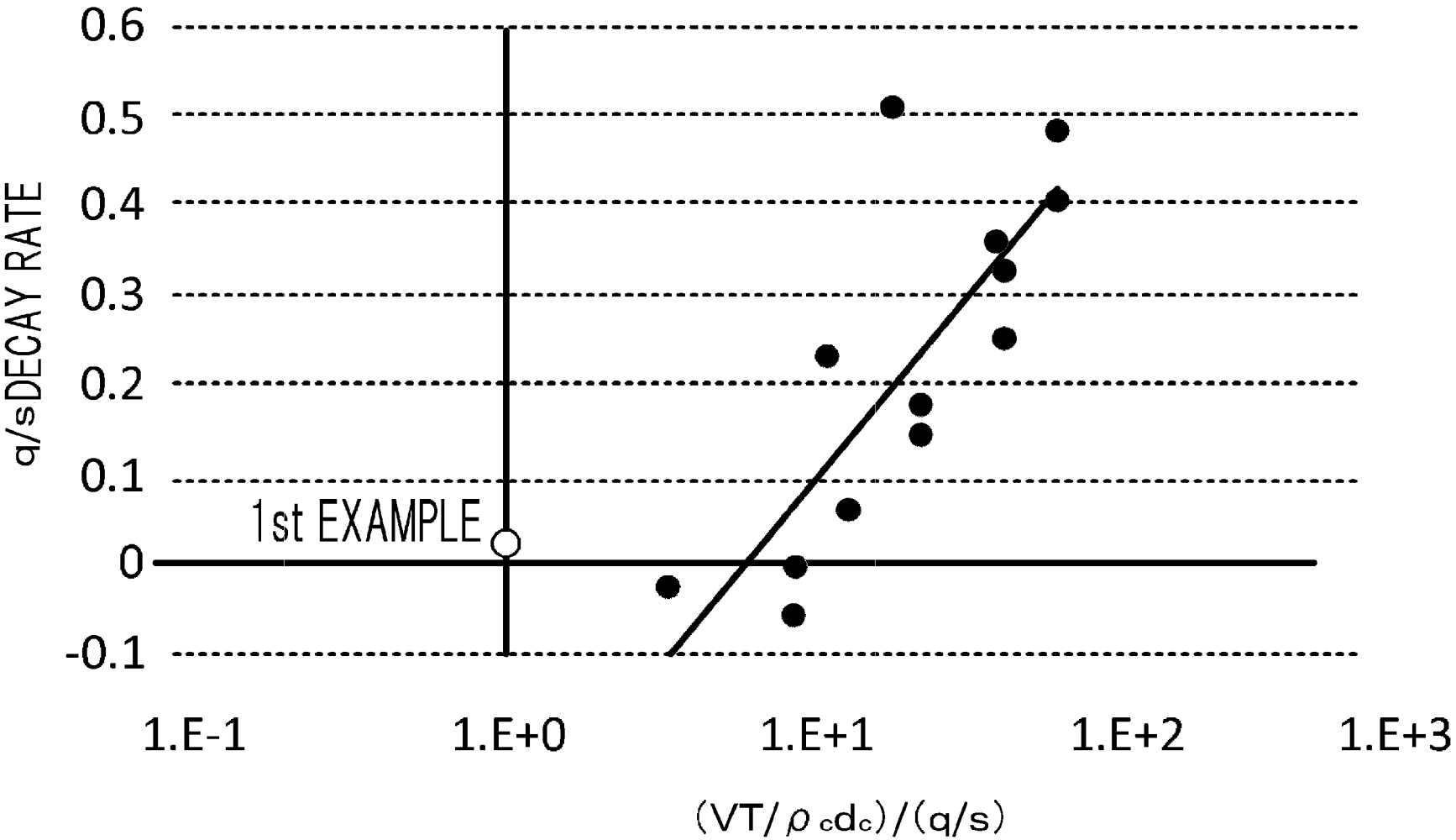
FIG. 9 is a graph illustrating the q/s decay.

FIGS. 7 to 9 are graphs illustrating q/s decay. In FIGS. 7 to 9, the ordinate shows the q/s decay rate (range: −0.1 to +0.6), and the abscissa shows the value of (Equation 9) (range: $1\times10^{-1}$ to $1\times10^{3}$).

Figure 7A:
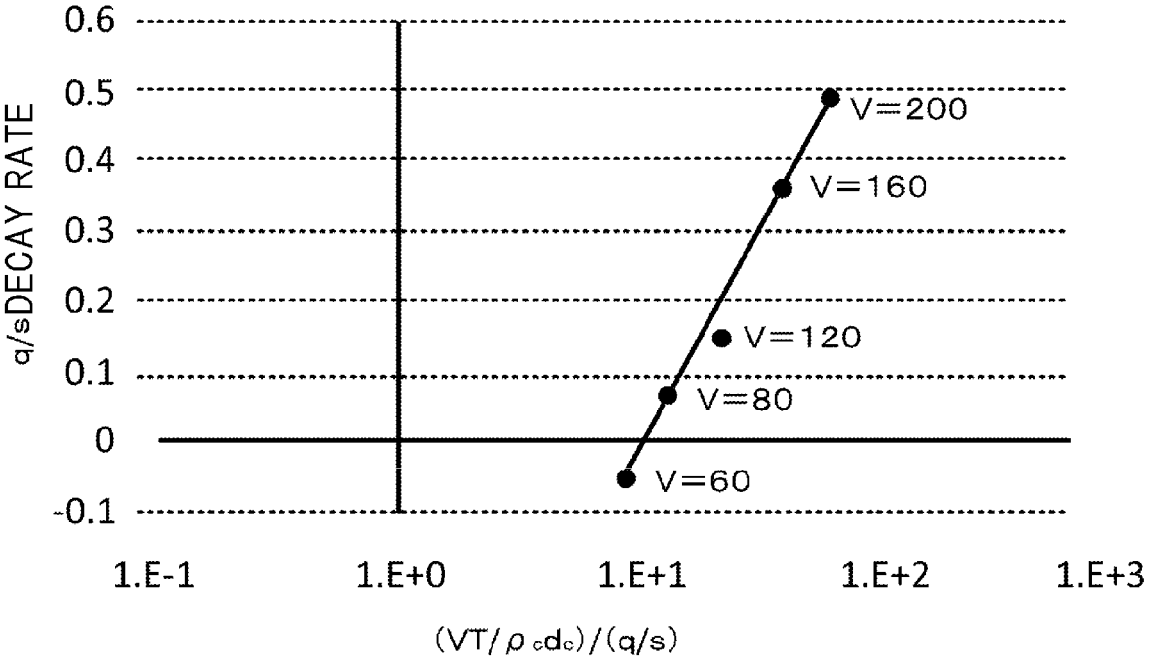
FIGS. 7A and 7B are graphs illustrating q/s decay.

First, q/s decay resulting from variation in the effective voltage V was verified. More specifically, the q/s decay rate relative to (Equation 9) was determined while varying the effective voltage V to 60 V, 80 V, 120 V, 160 V, and 200 V. Results are shown in FIG. 7A. It can be seen from the results that when the value of the effective voltage V is increased, the q/s decay rate increases as the value of (Equation 9) increases.

Figure 7B:
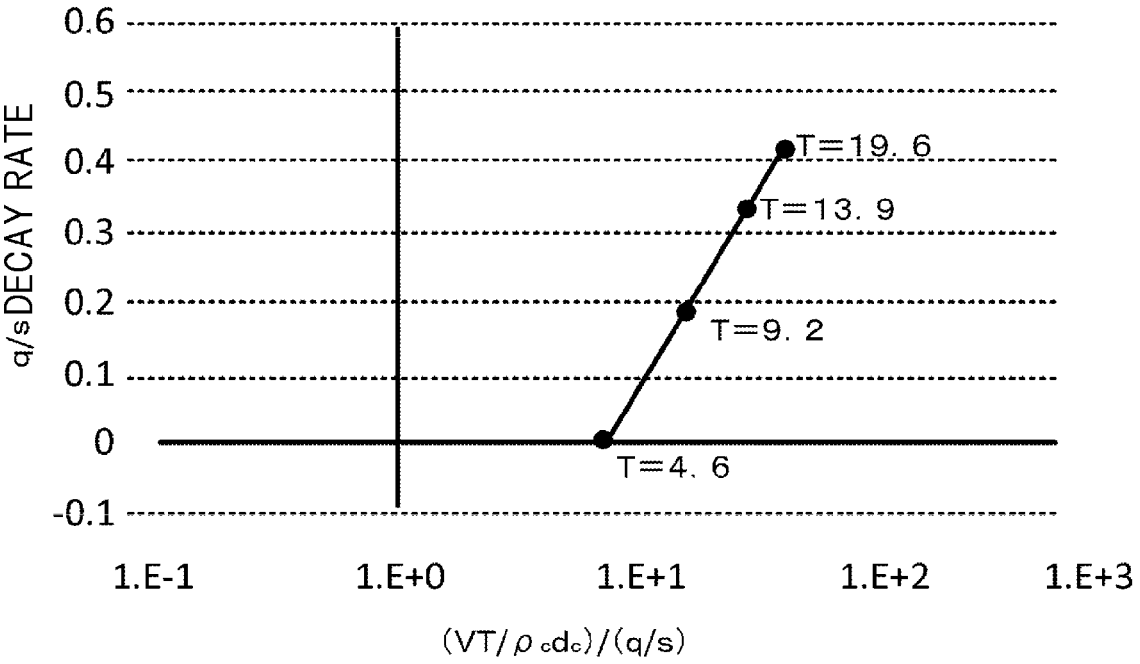

Further, the q/s decay rate relative to variation in the passage time T through the developing nip portion N was determined by varying the process speed such that the passage time T through the developing nip portion N varied to 4.6 ms, 9.2 ms, 13.9 ms, and 19.6 ms. Results are shown in FIG. 7B. It can be seen from the results that when the value of the passage time T through the developing nip portion N is increased, the q/s decay rate increases as the value of (Equation 9) increases.

Furthermore, FIG. 8A shows results obtained when the film thickness dc of the surface layer was varied to 10 μm and 60 μm. It can be seen from FIG. 8A that when the film thickness dc of the surface layer is increased, the q/s decay rate increases as the value of (Equation 9) increases. Moreover, FIG. 8B shows results obtained when the toner charge q/s was varied to $1.64\times10^{-5}$ C/m$^2$, $2.56\times10^{-5}$ C/m$^2$, and $3.28\times10^{-5}$ C/m$^2$. It can be seen from these results that when the value of q/s is reduced, the q/s decay rate increases as the value of (Equation 9) increases. Note that q/s fluctuation was achieved by varying the amount of external additives added to the toner.

FIG. 9 shows the results of FIGS. 7A, 7B, 8A, and 8B summarized on a graph. As shown in FIG. 9, it is evident that a strong correlative relationship exists between (Equation 9), i.e. the value of the ratio of the surface charge density of the developing roller to the surface charge density of the toner, and the decay rate of the surface charge density of the toner.

FIG. 9 also shows the value of (Equation 9) in the first example employing the developing roller A. It can be seen that the ratio of (Equation 9) under the conditions of the first example is equal to or smaller than 1, or in other words satisfies (Equation 1), and therefore decay of the charge amount can be suppressed dramatically.

Figure 11:
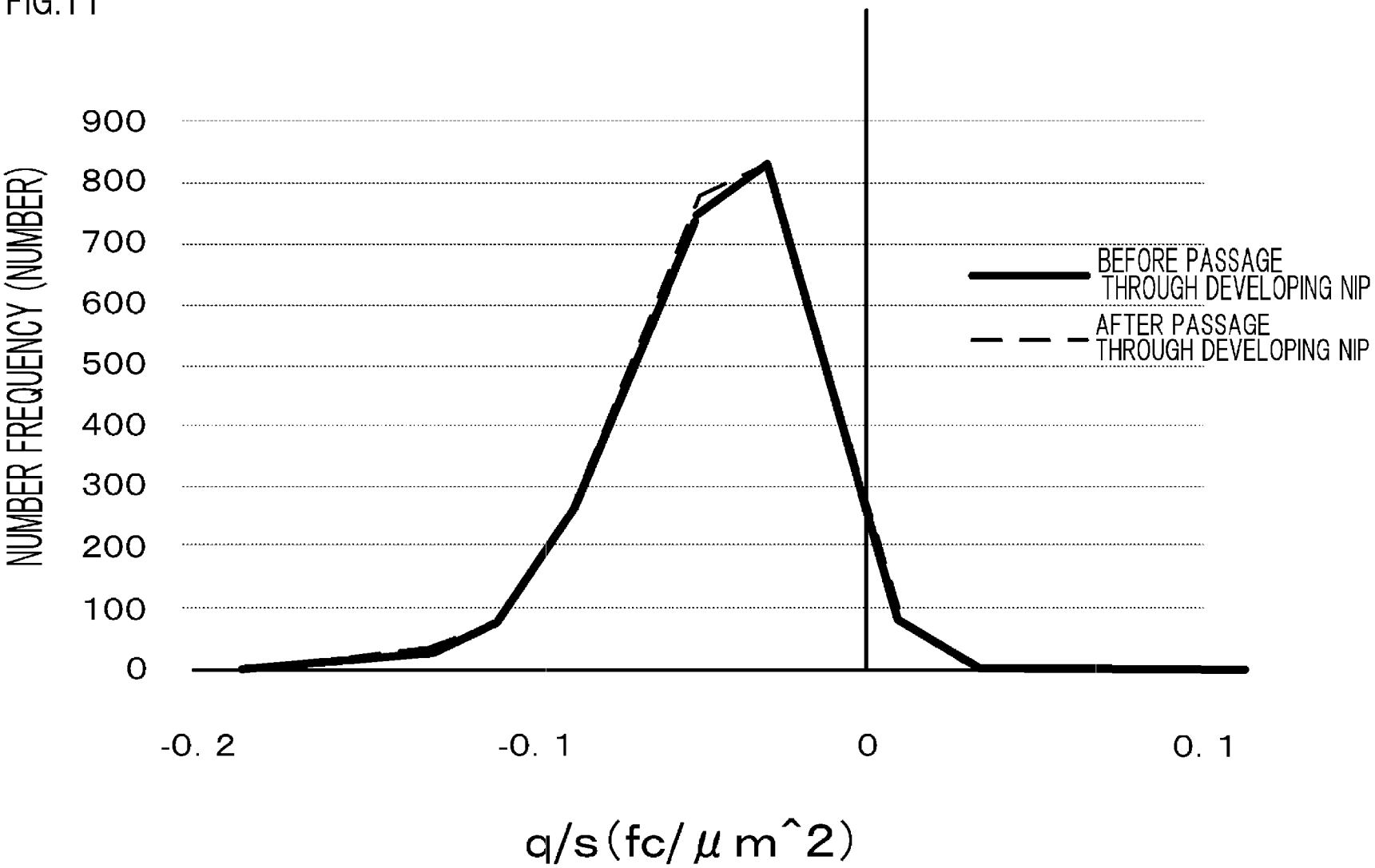
FIG. 11 is a graph comparing the surface charge density of the toner before and after passage through the developing nip portion.

FIG. 11 is a graph comparing the surface charge density of the toner q/s before and after passage through the developing nip portion using the developing roller A. The ordinate of FIG. 11 shows the number of toner samples taking the corresponding value of the charge density shown on the abscissa. In this example, 3000 toner samples were measured. It is evident from FIG. 11 that q/s decay is suppressed following passage through the developing nip portion. In other words, decay of the toner charge amount is suppressed by satisfying (Equation 1), and as a result, the amount of fog can be suppressed dramatically.

It has also been found that when a circumferential speed difference between the photosensitive drum 1 and the developing roller 14 increases, the amount of decay in the toner charge increases. The reason for this is believed to be that since the toner 12 contacts the developing roller while rotating, the probability of contact between the charge on the toner surface and the charge induced on the surface of the developing roller 14 increases. For this reason also, the charge decay mechanism described above is believed to be correct.

Next, conditions of the present invention expressed by (Equation 10), shown below, will be described.

[Math. 9]

$$\frac{d_c}{\varepsilon_c} < \frac{d_t}{\varepsilon_t} \quad \text{(Equation 10)}$$

Here, during the development process, a voltage divided by a dielectric component acts respectively on the toner layer and the developing roller surface layer. An induced charge amount Q at this time is expressed by (Equation 11), shown below.

[Math. 10]

$$Q=C_tV_t=C_cV_c \quad \text{(Equation 11)}$$

Cc is the capacitance of the surface layer, and Vc is the shared voltage of the surface layer. Ct is the capacitance of the toner layer, and Vt is the shared voltage of the toner layer. When the shared voltage Vc of the surface layer increases beyond the shared voltage Vt of the toner layer, a voltage required for development can no longer be obtained, and therefore the amount of toner that can be developed decreases dramatically, leading to deterioration of a development performance. In other words, to suppress a reduction in the development performance, Vt/Vc>1 must be satisfied. To put it another way, CC/Ct>1 can be obtained from (Equation 11). Further, (Equation 10) can be obtained by establishing a relationship of Cc=∈c∈0S/dc, Ct=∈t∈0S/dt. Here, EC is the relative dielectric constant of the surface layer of the developing roller.

The form of d/∈ exhibits an electrically equivalent thickness. In other words, when the electrically equivalent thickness of the surface layer is greater than that of the toner layer, the developing characteristic approaches that of the developing roller, and therefore a high voltage is required for development. As a result, a sufficient potential difference cannot be secured between a developed portion and an undeveloped portion, and therefore a tendency to lose clarity on the edge portions of a gray image becomes more striking.

Figures 10A, 10B:
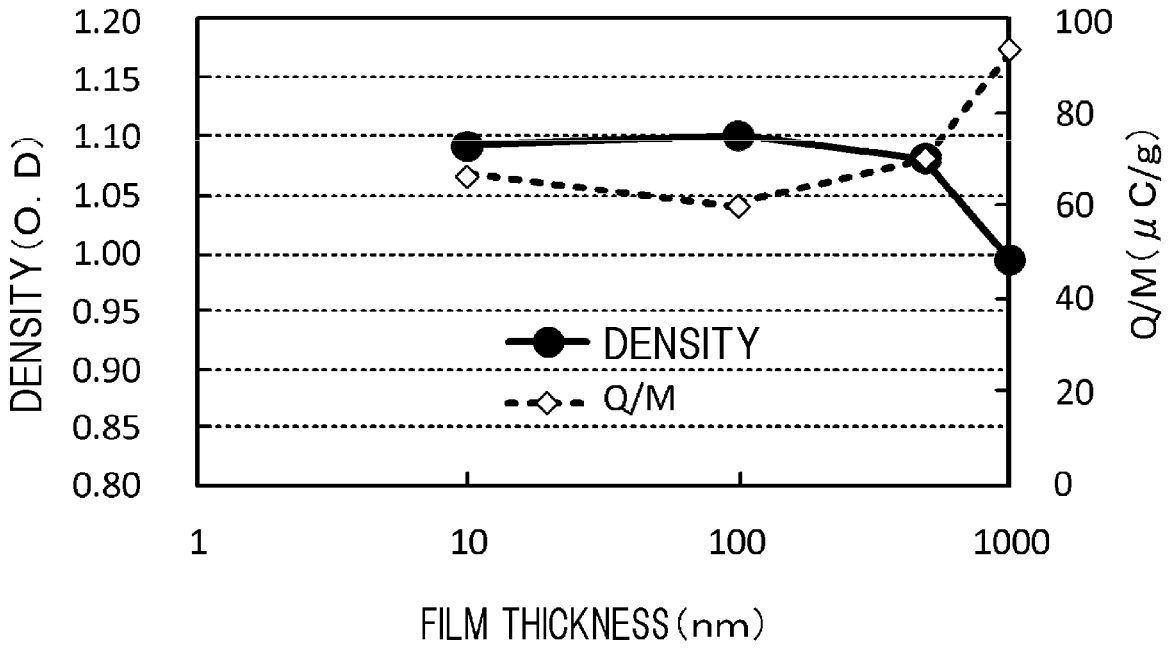
FIGS. 10A and 10B are views showing transitions of a solid density and an average charge amount relative to a film thickness.

Further, referring to FIG. 10, the film thickness of the surface layer will be described. FIG. 10 shows transitions of a solid density and an average charge amount Q/M [μC/g] relative to the film thickness. M is a mass [g] of the toner charge. FIG. 10A is a graph showing the transitions of the density and the average charge amount relative to the film thickness, and FIG. 10B is a table showing the density and the average charge amount when the film thickness (nm) is 10, 100, 500, and 1000. The inventors found, through committed research, that if the thickness of the surface layer equals or exceeds 1 μm (1000 nm), a reduction in density may occur even when (Equation 10) is satisfied.

It is evident from FIG. 10 that at 1 μm (1000 nm), the charge amount increases dramatically and the density decreases. This phenomenon is believed to occur because the charge amount of the toner layer formed on the developing roller is larger than a charge amount required to compensate for a development contrast (||Vdc−Vl||). In other words, when the surface layer is formed at or above 1 μm, the charge amount of the toner increases dramatically, and therefore the amount of toner applied to the development contrast decreases, leading to a reduction in development efficiency.

The development mechanism described above will now be considered briefly. The Al203 surface layer of the developing roller A is formed on the surface of the developing roller, which includes an elastic layer, by vacuum deposition using electron beam heating. Meanwhile, the developing roller A contacts the regulating blade 16 and the photosensitive drum 1, and therefore a small amount of deformation occurs in the resulting contact regions. It is believed that the surface layer follows this movement, causing fine particle aggregates to form. With a surface layer of less than 1 μm, therefore, toner charge leakage to the developing roller side may occur locally through gaps between the particle aggregates. Further, it is believed that a tunnel current is dominant in the charge movement occurring at this time.

When the surface layer is larger than 1 μm, on the other hand, the developing roller surface layer is almost completely covered thereby, and as a result, charge leakage to the developing roller side is believed not to occur. Furthermore, when the film thickness of the surface layer increases, displacement of the surface layer occurs over a wider range than the contact region, but the amount of deformation in the surface layer itself is small, and therefore fine particle aggregates are less likely to form. As a result, leakage is less likely to occur, leading to a dramatic increase in the charge amount on the toner layer and a reduction in density.

In other words, according to the present invention, by satisfying (Equation 10), a voltage condition required for development is satisfied so that the development performance is maintained, and by setting the film thickness of the surface layer below 1 μm, local leakage is generated such that an excessive increase in the toner charge is suppressed. As a result, the amount of fog can be suppressed dramatically while maintaining the development performance.

Table 2 shows fog evaluation results obtained in the first embodiment (the first and second examples and the first and second comparative examples), and Table 3 shows fog evaluation results obtained in the second embodiment (the third and fourth examples and the third and fourth comparative examples). Note that a similar fog evaluation method to that of the first example was employed. The evaluation results were divided into five levels and ranked.

xx: A fog amount of 5.0% or more x: A fog amount of no less than 3.0% and less than 5.0%

Δ: A fog amount of no less than 1.0% and less than 3.0%

○: A fog amount of no less than 0.5% and less than 1.0%

◎: A fog amount of less than 0.5%

Note that fog evaluations obtained after printing 100 sheets are marked as "initial fog" on the tables, and fog evaluations obtained after printing 3000 sheets are marked as "durable fog" on the tables.

As shown on Tables 2 and 3, in the first and third comparative examples using the developing roller B, the average surface charge density of the toner was −24 μC/m$^2$. Further, in the second and fourth comparative examples using the developing roller C, which has a greater average resistance than the developing roller B, the surface charge of the toner was −38 μC/m$^2$.

In the second and fourth examples using the developing roller E, in which the film thickness of the surface layer was set at 0.2 μm (200 nm) and the volume resistance was set at 3.0×10$^{14}$ Ωcm, the surface charge of the toner was −32 μC/m$^2$.

TABLE 2

| | | Surface layer | | | | (α) | | |
|---|---|---|---|---|---|---|---|---|
| | Developing roller | Material | Film thickness $d_c$(μm) | Relative dielectric constant $\in_c$ | Volume resistance $\rho_c$(Ωcm) | Toner surface charge Q/S(uC/m$^2$) | (β) VT/$\rho_c d_c$ (μC/m$^2$) | Ratio β/α |
| 1st example | A | Al2O3 | 0.1 | 10 | 10^14 | −32 | 6.2 | 0.2 |
| 1st comparative example | B | Urethane with roughening particles and conductive agent | 10 | 7 | 10^8 | −24 | 1.2 × 10^5 | 5200 |
| 2nd comparative example | C | Urethane | 10 | 7 | 10^10 | −38 | 1.2 × 10^3 | 33 |
| 2nd example | E | Al2O3 | 0.2 | 10 | 3.0 × 10^14 | −32 | 2.0 | 0.06 |

TABLE 2-continued

| | (γ) $V_{back}T/\rho_c d_c$ (μC/m²) | Ratio γ/α | $\lvert VT/\rho_c d_c \rvert <$ \|q/s | $\lvert V_{back}T/\rho_c d_c \rvert <$ \|q/s\| | Initial fog (normal speed) | Initial fog (low speed) | Durable fog (normal speed) | Durable fog (low speed) |
|---|---|---|---|---|---|---|---|---|
| 1st example | 16 | 0.5 | ○ | ○ | ◎ | ◎ | ◎ | ◎ |
| 1st comparative example | 3.1 × 10^5 | 13000 | X | X | ○ | X | X | X X |
| 2nd comparative example | 3.1 × 10^3 | 82 | X | X | ○ | Δ | Δ | X |
| 2nd example | 0.16 | 0.16 | ○ | ○ | ◎ | ◎ | ◎ | ◎ |

TABLE 3

| | Developing roller | Surface layer Material | Film thickness $d_c$(μm) | Relative dielectric constant $\in_c$ | Volume resistance $\rho_c$(Ωcm) | (α) Toner surface charge Q/S(uC/m²) | (β) $VT/\rho_c d_c$ (μC/m²) | Ratio β/α |
|---|---|---|---|---|---|---|---|---|
| 3rd example | A | Al2O3 | 0.1 | 10 | 10^14 | −32 | 16 | 0.5 |
| 3rd comparative example | B | Urethane with roughening particles and conductive agent | 10 | 7 | 10^8 | −24 | 3.1 × 10^5 | 13000 |
| 4th comparative example | C | Urethane | 10 | 7 | 10^10 | −38 | 3.1 × 10^3 | 82 |
| 4th example | E | Al2O3 | 0.2 | 10 | 3.0 × 10^14 | −32 | 2.0 | 0.06 |

| | (γ) $V_{back}T/\rho_c d_c$ (μC/m²) | Ratio γ/α | $\lvert VT/\rho_c d_c \rvert <$ \|q/s | $\lvert V_{back}T/\rho_c d_c \rvert <$ \|q/s\| | Initial fog (normal speed) | Initial fog (low speed) | Durable fog (normal speed) | Durable fog (low speed) |
|---|---|---|---|---|---|---|---|---|
| 3rd example | 40 | 1.2 | ○ | X | ○ | ○ | ○ | Δ |
| 3rd comparative example | 7.8 × 10^5 | 33000 | X | X | X | X X | X X | X X |
| 4th comparative example | 7.8 × 10^3 | 206 | X | X | Δ | X | X X | X X |
| 4th example | 0.16 | 0.16 | ○ | ○ | ◎ | ◎ | ◎ | ◎ |

<Fog Evaluation Results of First Embodiment>

In the first comparative example, fog is initially favorable in the normal speed mode. The reason for this is that Vback is small and the passage time T through the developing nip portion N is short, and therefore the toner charge is believed to be unlikely to escape to the developing roller side. Further, toner deterioration has not progressed, and therefore an absolute quantity of the toner charge amount is large. Hence, even when the toner charge decays, an increase in the amount of fog can be suppressed dramatically. However, in the low speed mode executed when thick paper or the like is passed, the passage time T through the developing nip portion N increases so that the toner charge is more likely to escape to the developing roller side, and as a result, an increase in the amount of fog is observed.

In the second comparative example, the resistance of the developing roller is increased to suppress escape to the developing roller side, and therefore the amount of fog increases in the low speed mode, albeit by a smaller amount than in the first comparative example.

In the first example of the present invention, on the other hand, fog can be suppressed in both the normal speed mode and the low speed mode, and therefore a favorable image can be obtained. The reason for this is that the charge induced on the developing roller surface is smaller than the surface charge density of the toner such that the probability of contact between the toner charge and the charge induced on the developing roller decreases, and as a result, decay of the toner charge is suppressed.

Furthermore, as shown in the durable fog column on Table 2, when the number of passed sheets increases, the amount of fog increases dramatically in both the first and second comparative examples. The reason for this is believed to be as follows.

First, when the number of printed sheets increases, toner deterioration advances, leading to a reduction in the toner charge amount. As a result, an increase in the fog amount is promoted. Further, the effective voltage V applied to the toner layer is expressed by V=Cp/(Cp+Ct) Vback. Cp is inversely proportionate to the film thickness of the charge transport layer on the photosensitive drum 1, and therefore, when the charge transport layer is scraped by the cleaning blade 9, Cp increases. Accordingly, the effect of Ct decreases such that the effective voltage V approaches Vback. As a result, the effective voltage V applied to the toner layer increases in the developing nip portion N, leading to decay of the toner charge and a dramatic increase in the amount of fog.

In the first example of the present invention, however, the density of the charge induced on the developing roller surface is smaller than the density of the charge on the toner surface, and therefore the amount of fog can be suppressed dramatically. Furthermore, in the second example of the present invention, the effective voltage V does not reach or exceed Vback, and therefore the charge induced on the developing roller surface is set to be smaller than the density of the charge on the toner surface when the effective voltage is at the value of Vback. As a result, the amount of fog can be suppressed dramatically even when the number of passed sheets increases.

As described above, by satisfying (Equation 1), toner charge decay can be suppressed, enabling a reduction in the amount of fog. Further, by satisfying (Equation 10), the voltage required by the developing roller 14 for development can be supplied, and therefore the development performance can be maintained. Moreover, by setting the film thickness dc of the surface layer of the developing roller 14 at less than 1 μm, local leakage is generated such that an excessive charge increase is suppressed. In the first and second examples, these conditions are satisfied, and therefore the amount of fog can be suppressed with stability both in the low speed mode, where the amount of fog increases easily, and when the number of printed sheets is increased. As a result, image formation can be performed favorably over time.

<Evaluation Results of Second Embodiment>

The image forming apparatus according to the second embodiment does not include the cleaning blade 9, and the untransferred toner that remains on the photosensitive drum 1 having not been transferred in the transfer process is made negative while passing the charging roller 2, and then collected in the developing assembly 4 in the developing nip portion N. Further, in the second embodiment, Vback is increased to 500 V in order to improve the collection performance by which return toner is collected in the developing nip portion N (Vback at this time will be referred to hereafter as high Vback).

In the third and fourth comparative examples using the conventional developing rollers B, C, therefore, the amount of fog increases dramatically. Moreover, a dramatic increase in the amount of fog occurs over time. In the third and fourth examples of the present invention, on the other hand, the density of the charge induced on the developing roller surface is set to be equal to or smaller than the density of the charge on the toner surface, and therefore toner charge decay and the amount of fog can both be suppressed dramatically. In the fourth example in particular, the effective voltage V is equal to or smaller than Vback, and therefore the charge induced on the developing roller surface is set to be smaller than the density of the charge on the toner surface when the effective voltage V is at the value of Vback. As a result, the amount of fog can be suppressed dramatically even when the number of passed sheets increases.

The amount of fog can be suppressed particularly dramatically when the high Vback is used, and therefore the high Vback can be used while maintaining a favorable toner collection performance by which the untransferred toner is collected in the developing assembly 4. As a result, more stable images can be obtained.

In the third and fourth examples of the present invention, as described above, the amount of fog can be suppressed with stability while maintaining a favorable toner collection performance not only in the low speed mode, where the amount of fog increases easily, and when the number of printed sheets increases, but also when the high Vback is used, and as a result, image formation can be performed favorably over time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-235290, filed on Nov. 13, 2013, which is hereby incorporated by reference herein in its entirety.

What is claimed is:

1. An image forming apparatus comprising:

an image bearing member capable of bearing a developer image that is formed by supplying a developer to a latent image formed on a surface thereof;

a developer carrying member that is provided to be capable of rotating while carrying the developer, and that supplies the developer to the image bearing member by contacting the image bearing member;

a regulating member that regulates a layer thickness of the developer carried on the developer carrying member; and a voltage applying device for applying a voltage to the developer carrying member, wherein the developer carrying member includes a conductive base layer and a surface layer covering the base layer, and when a volume resistance of the surface layer is $\rho_c$, a film thickness of the surface layer is $d_c$, and a relative dielectric constant of the surface layer is $\in_c$, a surface charge density of an individual toner particle surface of the developer on the developer carrying member, the layer thickness of the developer having been regulated by the regulating member, is q/s, a relative dielectric constant of an entire layer of the developer is $\in_t$, and the layer thickness of the developer is $d_t$, a potential of the surface of the image bearing member in a contact region with the developer carrying member is V, and a time required for the developer to pass through the contact region after entering the contact region as the developer carrying member rotates is T, $$\left|\frac{VT}{\rho_c d_c}\right| \leq \left|\frac{q}{s}\right|$$

$$\frac{d_c}{\varepsilon_c} \leq \frac{d_t}{\varepsilon_t},$$

and are satisfied.

2. The image forming apparatus according to claim 1, wherein the film thickness $d_c$ is smaller than 1 μm.

3. The image forming apparatus according to claim 1, further comprising:

a charging device for charging the surface of the image bearing member; and an exposure device for forming the latent image by exposing the charged surface of the image bearing member, wherein, when a capacitance of the image bearing member is $C_p$, a capacitance of the developer on the developer carrying member, the layer thickness of the developer having been regulated by the regulating member, is $C_t$, and a potential difference between a surface potential of an unexposed region of the surface of the image bearing member charged by the charging device and a surface potential of the developer carrying member is $V_{back}$, $$V = \frac{C_p}{C_p + C_t} V_{back}$$

is satisfied.

4. The image forming apparatus according to claim 1, wherein the image bearing member is provided to be capable of rotating such that a surface movement direction in the contact region is identical to a direction of the developer carrying member, and the developer carrying member rotates at a higher rotation speed than the image bearing member.

5. The image forming apparatus according to claim 1, wherein the developer carrying member is provided to be capable of contacting and separating from the image bearing member.

6. The image forming apparatus according to claim 1, wherein the image bearing member includes a first mode for rotating at a first speed and a second mode for rotating at a second speed that is higher than the first speed.

7. The image forming apparatus according to claim 1, wherein the developer is a single component non-magnetic toner.

8. The image forming apparatus according to claim 1, wherein the surface layer is formed from alumina.

9. An image forming apparatus comprising:

an image bearing member capable of bearing a developer image that is formed by supplying a developer to a latent image formed on a surface thereof;

a charging device for charging the surface of the image bearing member;

an exposure device for forming the latent image by exposing the charged surface of the image bearing member;

a developer carrying member that is provided to be capable of rotating while carrying the developer, and that supplies the developer to the image bearing member by contacting the image bearing member;

a regulating member that regulates a layer thickness of the developer carried on the developer carrying member; and a voltage applying device for applying a voltage to the developer carrying member, wherein the developer carrying member includes a conductive base layer and a surface layer covering the base layer, and when a volume resistance of the surface layer is $\rho_c$, a film thickness of the surface is $d_c$, and a relative dielectric constant of the surface layer is $\in_c$, a surface charge density of an individual toner particle surface of the developer on the developer carrying member, the layer thickness of the developer having been regulated by the regulating member, is q/s, a relative dielectric constant of an entire layer of the developer is $\in_t$, and the layer thickness of the developer is $d_t$, a potential difference between a surface potential of an unexposed region of the surface of the image bearing member charged by the charging device and a surface potential of the developer carrying member is $V_{back}$, and a time required for the developer to pass through the contact region after entering the contact region as the developer carrying member rotates is T, $$\left|\frac{V_{back} T}{\rho_c d_c}\right| \leq \left|\frac{q}{s}\right|$$

$$\frac{d_c}{\varepsilon_c} \leq \frac{d_t}{\varepsilon_t},$$

and are satisfied.

10. The image forming apparatus according to claim 9, wherein the film thickness $d_c$ is smaller than 1 μm.

* * * * *